US012668938B2

(12) United States Patent
Wisebrod

(10) Patent No.: US 12,668,938 B2
(45) Date of Patent: Jun. 30, 2026

(54) SNOWPLOW ASSEMBLY AND METHODS OF USE THEREOF

(71) Applicant: Ruff Stuff Inc, Vaughan (CA)

(72) Inventor: Raphi Wisebrod, Vaughan (CA)

(73) Assignee: Ruff Stuff Inc, Vaughan (CA)

( * ) Notice: Subject to any disclaimer, the term of this patent is extended or adjusted under 35 U.S.C. 154(b) by 520 days.

(21) Appl. No.: 18/018,122

(22) PCT Filed: Jul. 27, 2021

(86) PCT No.: PCT/IB2021/056823
§ 371 (c)(1),
(2) Date: Jan. 26, 2023

(87) PCT Pub. No.: WO2022/023981
PCT Pub. Date: Feb. 3, 2022

(65) Prior Publication Data

US 2023/0279627 A1 Sep. 7, 2023

Related U.S. Application Data

(60) Provisional application No. 63/057,416, filed on Jul. 28, 2020.

(51) Int. Cl.
*E02F 3/407* (2006.01)
*E01H 5/06* (2006.01)

(52) U.S. Cl.
CPC ..... *E01H 5/068* (2013.01); *E01H 5/062* (2013.01); *E01H 5/065* (2013.01)

(58) Field of Classification Search
None
See application file for complete search history.

(56) References Cited

U.S. PATENT DOCUMENTS

| | | | | |
|---|---|---|---|---|
| 1,276,672 | A | 8/1918 | Mason, Jr. | |
| 3,526,979 | A | 9/1970 | Ladewski | |
| 4,658,519 | A | 4/1987 | Quenzi | |
| 4,796,367 | A | 1/1989 | Kulat | |
| 5,050,322 | A * | 9/1991 | Burkard | E01H 5/068 37/270 |
| 5,560,129 | A * | 10/1996 | Rothbart | B66F 9/12 37/231 |
| 6,202,328 | B1 * | 3/2001 | Fulton | E01H 5/068 37/231 |
| 6,983,558 | B2 | 1/2006 | Haas | |
| 2004/0211095 | A1 * | 10/2004 | Haas | E01H 5/068 37/269 |
| 2013/0232827 | A1 | 9/2013 | Summers et al. | |

FOREIGN PATENT DOCUMENTS

| | | | |
|---|---|---|---|
| DE | 202014103366 | U1 | 7/2014 |
| GB | 721782 | A | 1/1955 |

* cited by examiner

*Primary Examiner* — Christopher J Sebesta
*Assistant Examiner* — Alfred H Tsui

(57) ABSTRACT

A snowplow assembly for attachment to a vehicle, comprising a first plow blade assembly and a second plow blade assembly, connectable to each other by a hinge; a support assembly fixedly couplable to the first plow blade assembly; and wherein the first and second plow blade assemblies are configured to be angularly adjustable relative to at least a portion of the support assembly.

20 Claims, 45 Drawing Sheets

SNOWPLOW ASSEMBLY AND METHODS OF USE THEREOF

REFERENCE TO RELATED APPLICATIONS

This application is a national stage filing under 35 U.S.C. § 371 of international application number PCT/IB2021/056823, filed Jul. 27, 2021, which claim priority to U.S. Provisional Patent Application Ser. No. 63/057,416, filed Jul. 28, 2020 and entitled "SNOWPLOW ASSEMBLY AND METHODS OF USE THEREOF", the disclosure of which is hereby incorporated by reference in its entirety and priority of which is hereby claimed pursuant to 37 CFR 1.78(a) (4) and (5)(i).

FIELD OF THE INVENTION

The present invention relates generally to snowplows for attachment to vehicles and more specifically to foldable and adjustable snowplows.

BACKGROUND OF THE INVENTION

Many snowplows are known, which are adapted to be connected to a vehicle and operative for snow removal from a certain area.

It is appreciated that many of the known snowplows are heavy and difficult for dis-assembly and storage.

SUMMARY OF THE INVENTION

The present invention seeks to provide an improved snowplow.

There is thus provided in accordance with an embodiment of the present invention a snowplow assembly, comprising a first plow blade assembly and a second plow blade assembly, connectable to each other by a hinge; a support assembly having a base arm extending along a longitudinal axis and having at least two arms extending in different angular directions with respect to the base arm, a first one of the at least two arms is selectably fixedly attached to the first plow blade assembly and a second one of the at least two arms is selectably fixedly attached to the second plow blade assembly, thus selectably fixating the first and second plow blades to the support assembly; and wherein adjustment of angular orientation of the first one of the at least two arms relative to the first plow blade assembly and adjustment of the second one of the at least two arms relative to the second plow blade assembly provides for adjustment of angular orientation of both the first and second plow blade assemblies relative to the base arm.

Preferably, at least one of the at least two arms is configured to be attached to either the first plow blade assembly or the second plow blade assembly by a bracket having an array of spaced apart openings formed therein and a fastener that is selectably insertable into one of the openings.

Further preferably, relative angular orientation between both the first and second plow blade assemblies and the base arm is configured to be adjusted by changing the position of the fastener to be inserted into a different one of the openings. Still further preferably, the snowplow assembly further comprises at least one extension configured to be releasably connected to at least one of the first and second plow blade assemblies, thereby increasing the effective length thereof. Yet further preferably, the support assembly further comprises a base portion that is pivotably connected to a hitch connector.

In accordance with an embodiment of the present invention, the base arm is pivotably connected to the first plow blade assembly or to the second plow blade assembly.

Preferably, the snowplow assembly further comprises a connecting rod, configured to connect the first plow blade assembly to the second plow blade assembly in a first operative orientation and configured to selectably release the second plow blade assembly from the first plow blade assembly in a second operative orientation, thereby allow folding of the first plow blade assembly relative to the second plow blade assembly about the hinge upon selectably detaching the second one of the at least two arms from the second plow blade assembly.

In accordance with an embodiment of the present invention, a snowplow assembly, comprising a first plow blade assembly and a second plow blade assembly, connectable to each other by a hinge; a support assembly having a base arm extending along a longitudinal axis and having at least two arms extending in different angular directions with respect to the base arm, a first one of the at least two arms is selectably fixedly attached to the first plow blade assembly and a second one of the at least two arms is selectably fixedly attached to the second plow blade assembly, thus selectably fixating the first and second plow blades to the support assembly; and a connecting rod, configured to connect the first plow blade assembly to the second plow blade assembly in a first operative orientation and configured to selectably release the second plow blade assembly from the first plow blade assembly in a second operative orientation, thereby allow folding of the first plow blade assembly relative to the second plow blade assembly about the hinge upon selectably detaching the second one of the at least two arms from the second plow blade assembly.

Preferably, adjustment of angular orientation of the first one of the at least two arms relative to the first plow blade assembly and adjustment of the second one of the at least two arms relative to the second plow blade assembly provides for adjustment of angular orientation of both the first and second plow blade assemblies relative to the base arm.

Further preferably, at least one of the at least two arms is configured to be attached to either the first plow blade assembly or the second plow blade assembly by a bracket having an array of spaced apart openings formed therein and a fastener that is selectably insertable into one of the openings.

Still further preferably, relative angular orientation between both the first and second plow blade assemblies and the base arm is configured to be adjusted by changing the position of the fastener to be inserted into a different one of the openings.

In accordance with an embodiment of the present invention, the snowplow assembly further comprises at least one extension configured to be releasably connected to at least one of the first and second plow blade assemblies, thereby increasing the effective length thereof.

Preferably, the support assembly further comprises a base portion that is pivotably connected to a hitch connector. Further preferably, the base arm is pivotably connected to the first plow blade assembly or to the second plow blade assembly.

There is provided in accordance with an embodiment of the present invention a snowplow assembly, comprising a first plow blade assembly and a second plow blade assembly, connectable to each other by a hinge; a support assembly fixedly couplable to the first plow blade assembly and comprising a connecting rod. The connecting rod is configured to selectably couple the support assembly with the second plow blade assembly, thus fixating the first and second plow blade assemblies relative to each other, and wherein the connecting rod is configured to selectably release the second plow blade assembly from the support assembly to allow folding of the first plow blade assembly relative to the second plow blade assembly about the hinge.

In accordance with an embodiment of the present invention, a snowplow assembly for attachment to a vehicle, comprising a first plow blade assembly and a second plow blade assembly, connectable to each other by a hinge; a support assembly fixedly couplable to the first plow blade assembly; and wherein the support assembly is pivotably positionable in two different operative orientations relative to the vehicle, a first raised operative orientation and a second lowered operative orientation.

Further in accordance with an embodiment of the present invention, a snowplow assembly for attachment to a vehicle, comprising a first plow blade assembly and a second plow blade assembly, connectable to each other by a hinge; a support assembly fixedly couplable to the first plow blade assembly; and wherein the first and second plow blade assemblies are configured to be angularly adjustable relative to at least a portion of the support assembly.

Still further in accordance with an embodiment of the present invention, a snowplow assembly for attachment to a vehicle, comprising a first plow blade assembly and a second plow blade assembly, connectable to each other by a hinge; a support assembly fixedly couplable to the first plow blade assembly and comprising a connecting rod; and wherein the first and second plow blade assemblies are pivotably folded so as to face each other upon releasing the connecting rod from the second plow blade assembly.

Preferably, the support assembly further comprising a supporting arm that is pivotably connected to a hitch connector and an adjusting bracket that is pivotably connected to the supporting arm and wherein the adjusting bracket is selectably pivotably connected to the connecting rod. Further preferably, the supporting arm is biased downwardly to the ground when not being secured in a raised operative orientation.

Still further preferably, the adjusting bracket is configured to be moveably coupled to the supporting arm, thereby providing automatic angular adjustment of the first and second plow blade assemblies relative to the supporting arm upon application of different load along the longitudinal extent of at least one of the plow blade assemblies. Alternatively, the adjusting bracket is configured to be fixed relative to the supporting arm when the connecting rod is coupled with the second plow blade assembly.

In accordance with an embodiment of the present invention, the connecting rod is securable to the supporting arm in a folded operative orientation of the snowplow assembly. Preferably, at least one replaceable lip is attached along at least a portion of an edge of a blade, forming part of the first and second plow blade assembly.

BRIEF DESCRIPTION OF THE DRAWINGS

The present invention will be understood and appreciated more fully from the following detailed description, taken in conjunction with the drawings in which.

DETAILED DESCRIPTION OF EMBODIMENTS OF THE INVENTION

Figure 1:
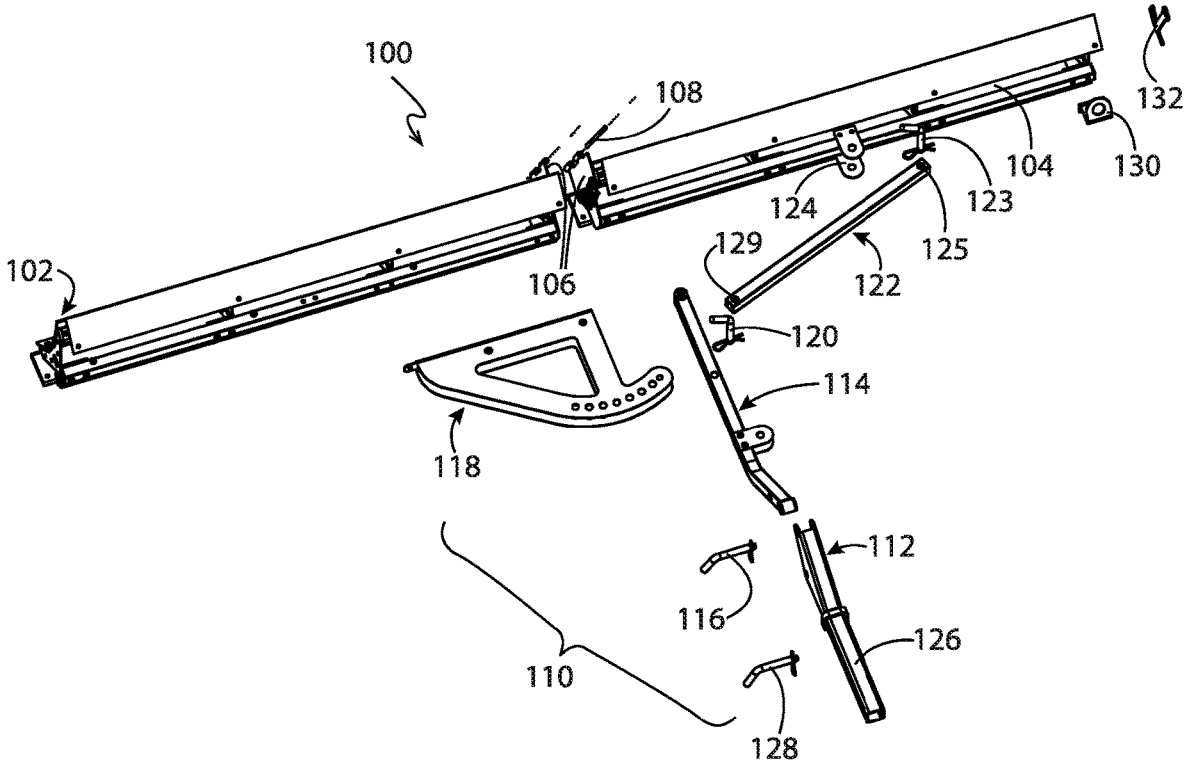
FIG. 1 is a simplified exploded view illustration of a snowplow assembly constructed and operative in accordance with an embodiment of the present invention.

Reference is now made to FIG. 1, which is a simplified exploded view illustration of a snowplow assembly constructed and operative in accordance with an embodiment of the present invention.

A snowplow assembly 100 is seen in FIG. 1, which preferably includes a first plow blade assembly 102 and a second plow blade assembly 104, which are adapted to be connected to each other by a pair of hinge brackets 106 intermeshed with each other. A hinge pin 108 is configured to be insertable through a bore formed by the pair of hinge brackets 106. The first plow blade assembly 102 and a second plow blade assembly 104 are configured to extend along a mutual longitudinal axis when connected to each other by the hinge brackets 106.

It is also seen in FIG. 1 that a vehicle connector and support assembly 110 is adapted to be connected to a hitch of a vehicle and to both the first plow blade portion 102 and to the second plow blade assembly 104.

The support assembly 110 preferably comprises a hitch connector 112 and a main support arm 114, which is preferably selectably pivotably connectable to the hitch connector 112.

It is a particular feature of an embodiment of the present invention that the main support arm 114 is positionable in two different operative orientations relative to the hitch connector 112, preferably by means of a securing pin 116. The main support arm 114 is positionable in a first raised operative orientation when the securing pin 116 couples the main support arm 114 to the hitch connector 112. The main support arm 114 is positionable in a second lowered operative orientation when the securing pin 116 is removed and does not couple the main support arm 114 to the hitch connector 112.

An adjusting bracket 118 is fixedly connectable to the first plow blade assembly 102. The adjusting bracket 118 is also selectably fixedly connectable to the main support arm 114 by means of an adjusting pin 120.

It is a particular feature of an embodiment of the present invention that the relative angular orientation between both plow blade assemblies 102 and 104 and between the main support arm 114 is configured to be adjusted by changing the angular positioning of the adjusting bracket 118 relative to the main support arm 114 and fixating a certain angular positioning using the adjusting pin 120.

It is a particular feature of an embodiment of the present invention that a connecting rod 122 is configured to selectably couple the support assembly 110 with the second plow blade assembly 104, thus fixating the first and second plow blade assemblies 102 and 104 relative to each other, and wherein the connecting rod 122 is configured to selectably release the second plow blade assembly 104 from the support assembly 110 to allow folding of the first plow blade assembly 102 relative to the second plow blade assembly 104 about the hinge brackets 106.

In accordance with an embodiment of the present invention, the connecting rod 122 is adapted to be connected to the second plow blade assembly 104 by means of pin 123, insertable through holding plates 124 and bore 125 formed at one end of the connecting rod 122. The holding plates 124 are adapted to be secured to the second plow blade assembly 104. It is noted that alternatively any other suitable connecting means operative to connect the connecting rod 122 to the second plow blade assembly 104 are within the scope of the present invention.

It is noted that that the first plow blade assembly 102 and the second plow blade assembly 104 extend along a single mutual longitudinal axis 155 when the connecting rod 122 couples the support assembly 110 with the second plow blade assembly 104.

It is noted that the hitch connector 112 may be attached to a hitch tube 126, which is connected to the frame of the vehicle, by means of pin 128. Alternatively, any other fastening means can be employed to secure the hitch connector 112 to the hitch tube 126.

It is noted that the connecting rod 122 has a bore 129 at a second end thereof.

It is further noted that a hanging element 130 and a latch 132 configured to latch the two plow blade assemblies together, are attachable to the second plow blade assembly 104.

Figure 2:
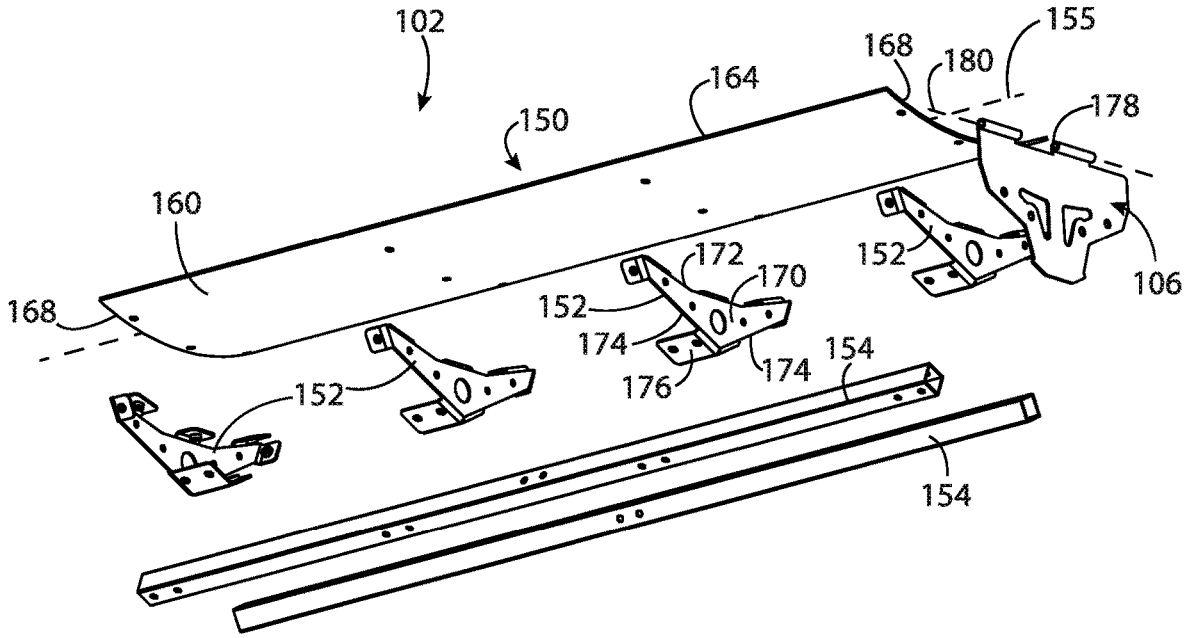
FIG. 2 is a simplified exploded view illustration of a snowplow blade assembly forming part of the snowplow assembly of FIG. 1.
Figure 3A:
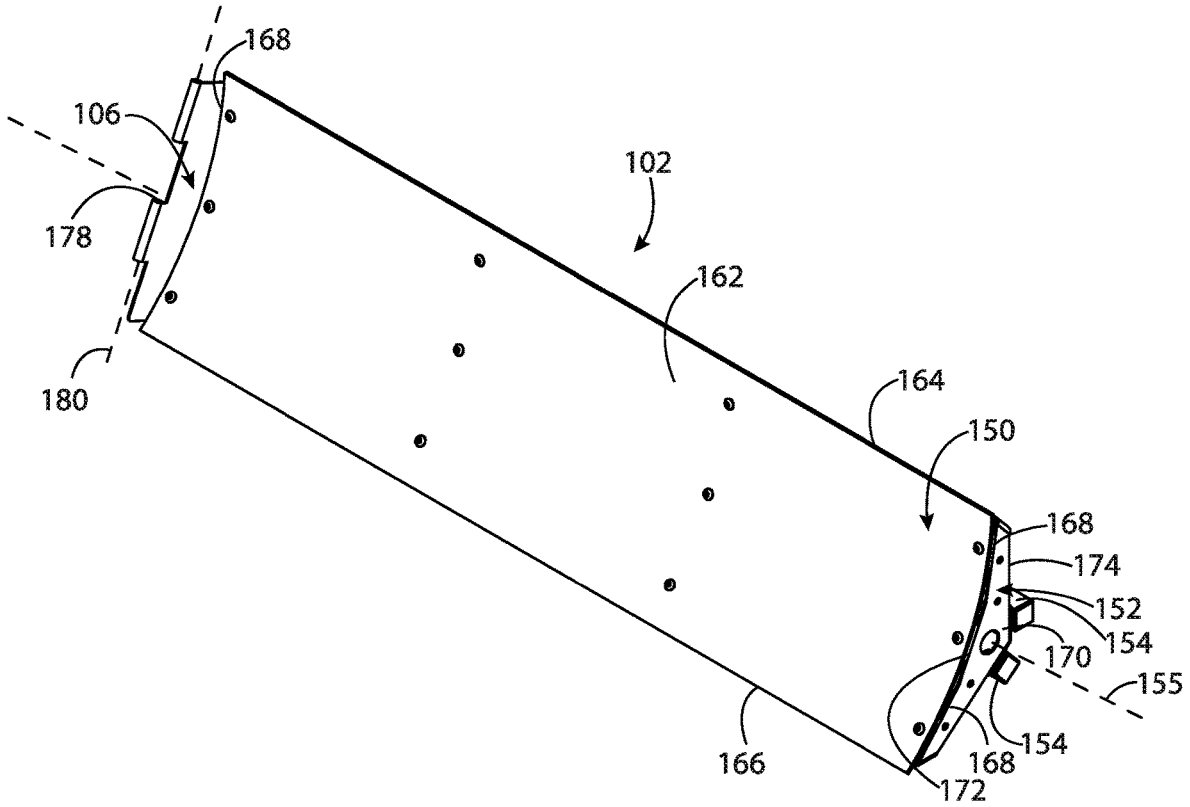
FIGS. 3A-3C are simplified assembled perspective view, rear plan view and side plan view of the snowplow blade assembly of FIG. 2.
Figure 3B:
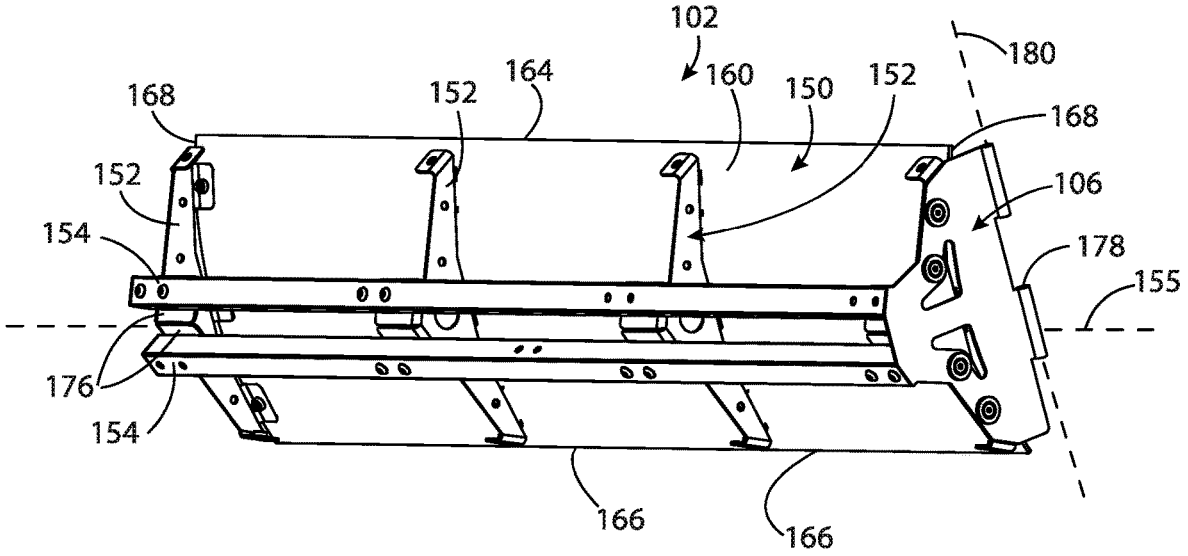
Figure 3C:
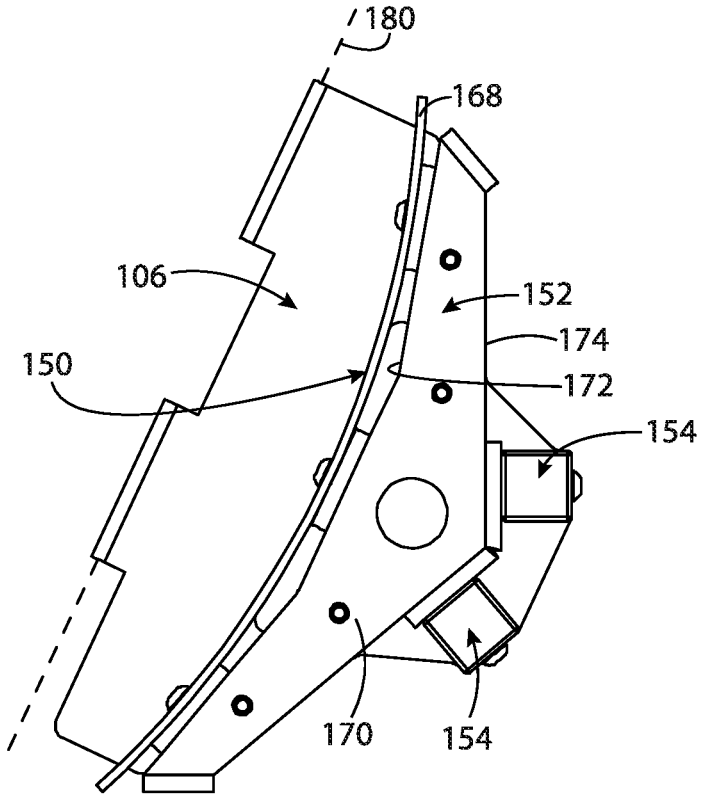

Reference is now made to FIG. 2, which is a simplified exploded view illustration of the plow blade assembly forming part of the snowplow assembly 100 of FIG. 1. Reference is additionally made to FIGS. 3A-3C, which are simplified assembled perspective view, rear plan view and side plan view of the snowplow blade assembly of FIG. 2.

It is appreciated that the first plow blade assembly 102 and the second plow blade assembly 104 are generally identical.

Referring specifically to FIG. 2, it is seen that the first plow blade assembly 102 preferably includes a blade 150, a plurality of holding brackets 152 configured to be attached to the blade 150 and typically two support rods 154, configured to be attached to the holding brackets 152. The hinge brackets 106 are attachable between the two plow blade assemblies 102 and 104.

It is noted that the blade 150 is a generally integrally formed element, generally made of a relatively resilient plastic and arranged along longitudinal axis 155. Once the holding brackets 152 are fixed to the blades 150, the blades 150 are curved to form a generally convex rearwardly facing surface 160 and a generally concave forwardly facing surface 162. The blade 150 defines an upper edge 164, a lower edge 166 and two mutually opposed side edges 168.

The holding brackets 152 are generally integrally formed and generally made of metal and adapted to support the blade 150. The holding brackets 152 preferably have a generally triangular base wall 170 defining a curved edge 172, adapted to conform with the rearwardly facing surface 160 of the blade and typically two generally straight edges 174. A protrusion 176 preferably extends from each of straight edges 174 and is arranged transversely with respect to base wall 170. Protrusions 176 are adapted for fixed connection with supporting rods 154.

Each of the supporting rods 154 is a generally hollow longitudinal integrally made element.

It is noted that any other suitable connecting means adapted for fixedly supporting the blade assemblies 102 and 104 and connect them to the support assembly 110 are within the scope of the present invention.

The hinge bracket 106 preferably includes a through bore 178 arranged along an axis 180, which extends generally transversely with respect to longitudinal axis 155.

Referring now specifically to FIGS. 3A-3C, it is seen that the holding brackets 152 are fixedly connected to the blade 150, such that the curved edge 172 is generally disposed adjacent the rearwardly facing surface 160. The supporting rods 154 are fixedly attached to protrusions 176 of the holding brackets 152. The hinge brackets 106 are fixedly attached to the respective base wall 170 of the holding bracket 152 that is disposed adjacent one of the side edges 168 of the blade 150 and is preferably also attached to an end of the supporting rod 154, that is disposed adjacent the same holding bracket 152.

It is noted that the hinge bracket 106 is attached to the blade 150 such that the through bore 178 thereof defining axis 180 is disposed forwardly of the forwardly facing surface 162 of blade 150.

Figure 4A:
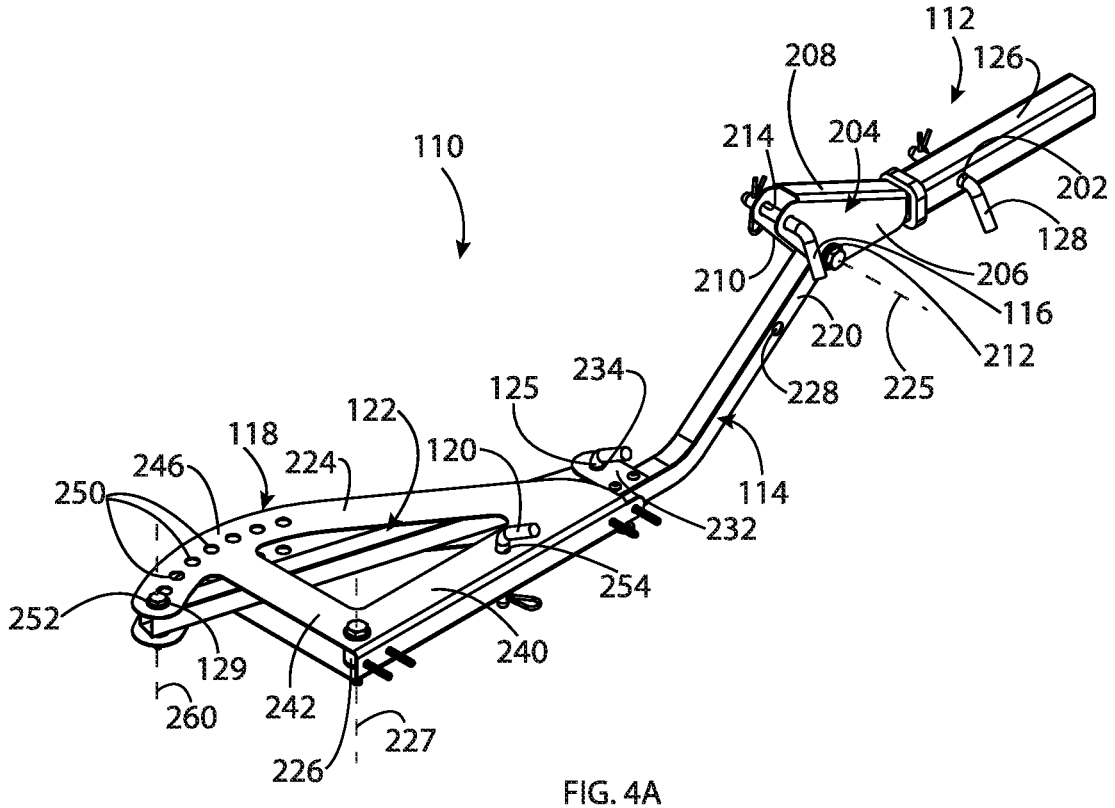
FIGS. 4A-4C are simplified assembled perspective view, side plan view and top plan view of a vehicle connector and supporting assembly, forming part of the snowplow assembly of FIG. 1.
Figure 4B:
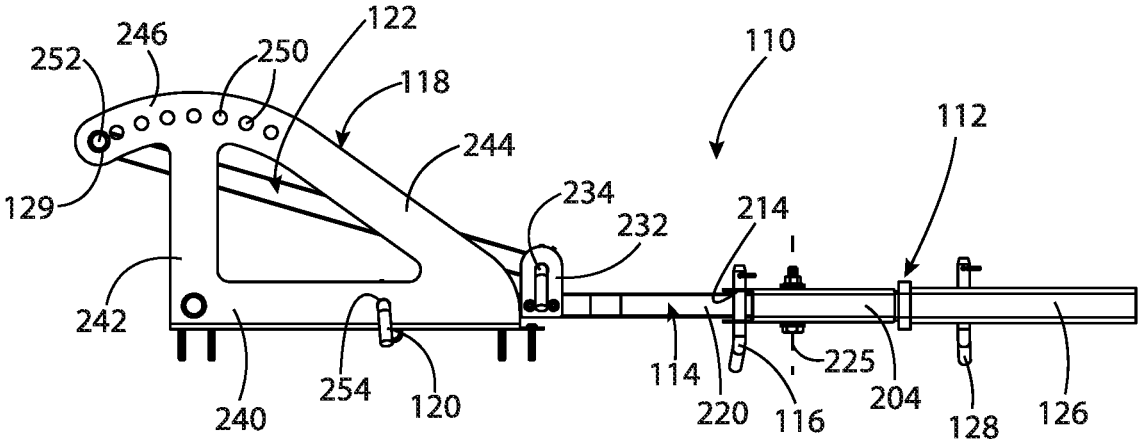
Figure 4C:
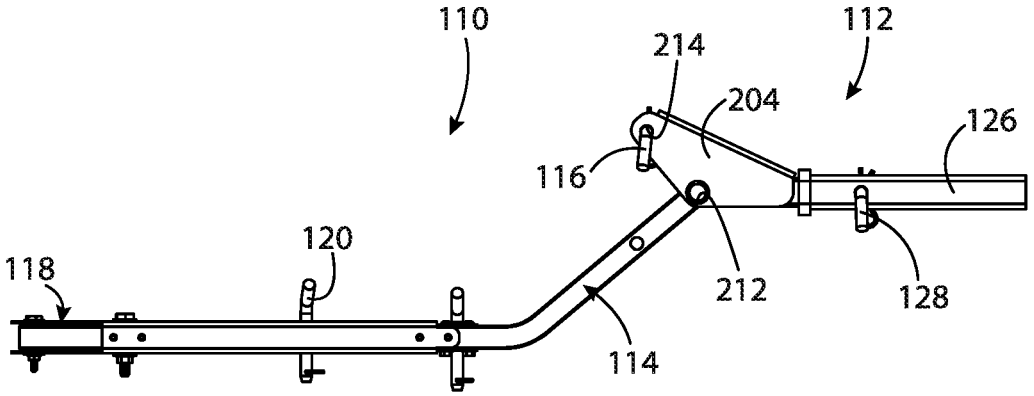
Figure 5:
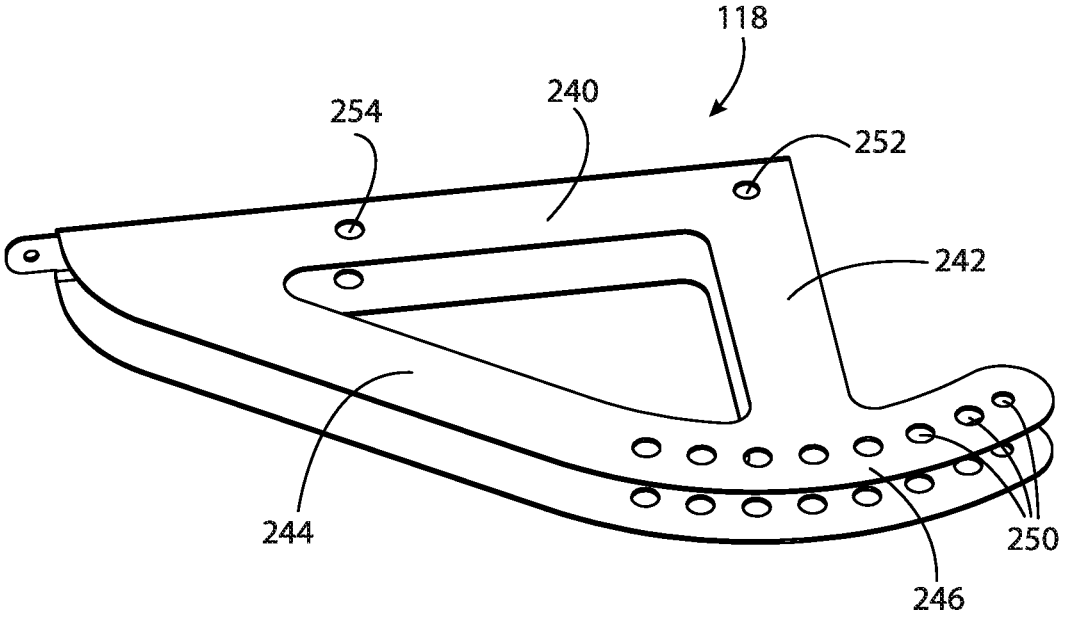
FIG. 5 is a simplified perspective view of an adjusting bracket, forming part of the vehicle connector and supporting assembly of FIGS. 4A-4C.
Figure 6:
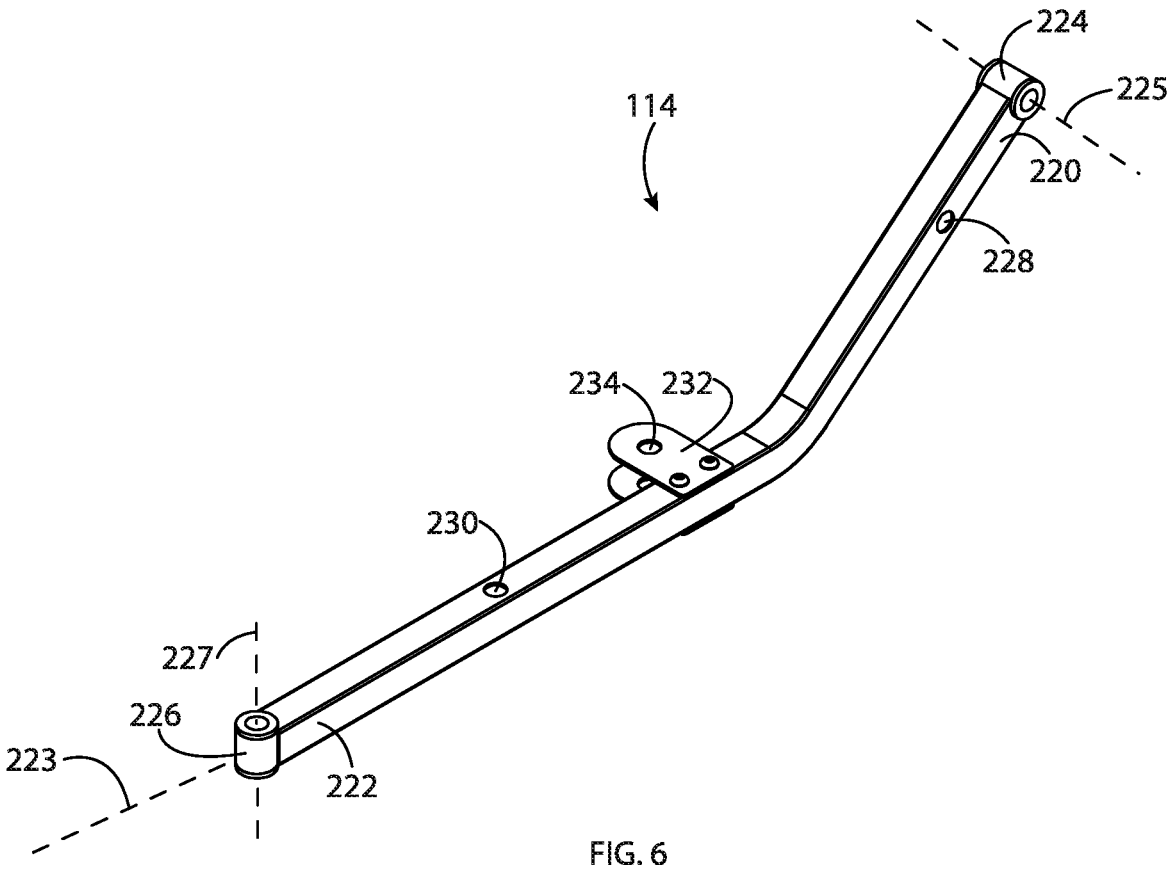
FIG. 6 is a simplified perspective view of a supporting arm assembly, forming part of the vehicle connector and supporting assembly of FIGS. 4A-4C.

Reference is now made to FIGS. 4A-4C, which are simplified assembled perspective view, side plan view and top plan view of the vehicle connector and supporting assembly 110, forming part of the snowplow assembly 100 of FIG. 1 and to FIG. 5, which is a simplified perspective view of the adjusting bracket 118, forming part of the vehicle connector and supporting assembly 110 of FIGS. 4A-4C. Reference is additionally made to FIG. 6, which is a simplified perspective view of the supporting arm assembly 114, forming part of the vehicle connector and supporting assembly 110 of FIGS. 4A-4C and to FIG. 7, which is a simplified perspective view of the hitch connector 112, forming part of the vehicle connector and supporting assembly 110 of FIGS. 4A-4C.

Figure 7:
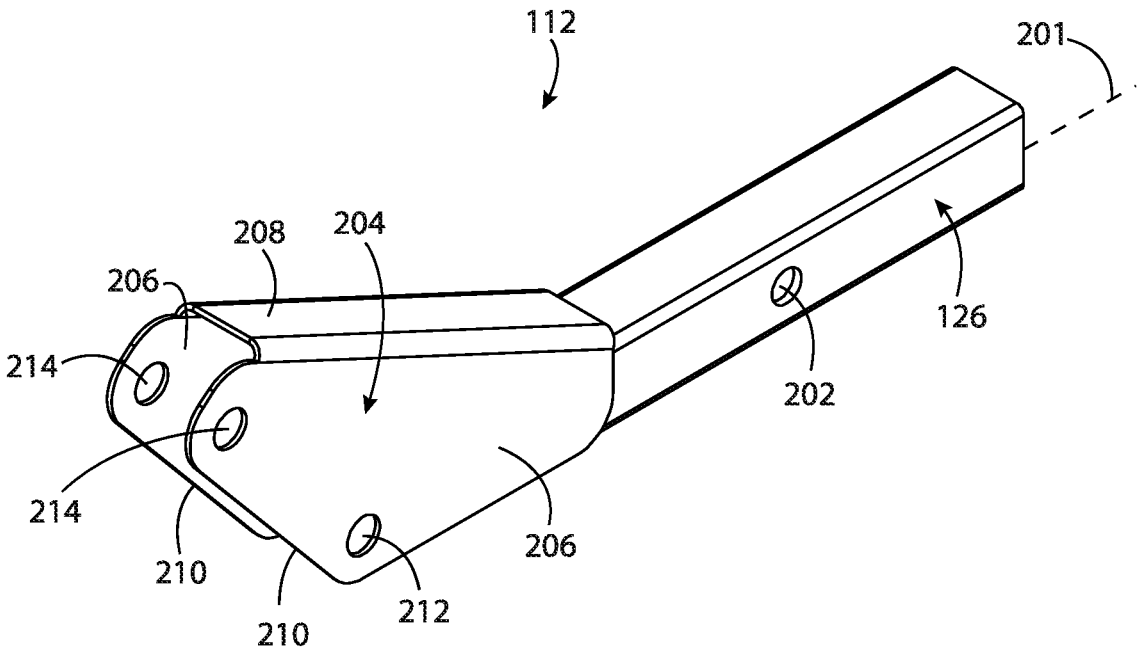
FIG. 7 is a simplified perspective view of a hitch connector, forming part of the vehicle connector and supporting assembly of FIGS. 4A-4C.

The support assembly 110 includes the hitch connector 112, as specifically shown in FIG. 7. It is seen that the hitch connector 112 has the hitch tube 126 extending along longitudinal axis 201. Preferably, a bore 202 is formed in the hitch tube 126 and typically extends transversely with respect to the tubular portion 200. The hitch 112 additionally has a fixating element 204. The fixating element 204 may be generally attached to the hitch tube 126 in a telescoping manner and attached thereto by means of pin 128 being inserted through bore 202. Alternatively, the fixating element 204 and the hitch tube 126 may be integrally formed.

It is noted that both the hitch tube 126 and the fixating element 204 are preferably made of metal. The hitch tube 126 is hollow and the fixating element 204 is a bent sheet of metal, both designed to be light-weight.

It is specifically seen in FIG. 7 that the fixating element 204 has typically two mutually facing side walls 206 connected by a connecting wall 208. Each of the side walls 206 has a typically tapered edge 210. A first opening 212 is formed on each of the side walls 206 and disposed generally along or near axis 201, the first openings 212 on both side walls 206 are aligned. A second opening 214 is formed on each of the side walls 206 and disposed generally offset from axis 201, the second openings 214 on both side walls 206 are aligned. Preferably, both the first openings 212 and the second openings 214 are formed adjacent the tapered edge 210 and typically extend transversely with respect to longitudinal axis 201.

It is seen in FIGS. 4A-4C that the main support arm 114, which is particularly seen in FIG. 6 is preferably selectably pivotably connected to the hitch connector 112.

Referring now specifically to FIG. 6, it is seen that the main support arm 114 is a generally longitudinal preferably bent element having a rearward end 220 and forward end 222 and being arranged along a longitudinal axis 223. A pivoting axle 224 is formed at the rearward end 220 of the support arm 114 and extends along axis 225. A pivoting axle 226 is formed at the forward end 222 of the support arm 114 and extends along axis 227, which is generally perpendicular to axis 225.

An opening 228 is formed generally adjacent the rearward end 220 and an opening 230 is formed generally adjacent the forward end 222.

It is additionally seen in FIG. 6 that a pair of mutually facing holding plates 232 are preferably attached to an intermediate location along the supporting arm 114. The holding plates 232 are fixedly attached to the support arm 114 and have mutually aligned openings 234 formed therethrough and extending along an axis that is preferably parallel to axis 227.

It is noted that the support arm 114 is hollow and configured to be light-weight.

The adjusting bracket 118, which is specifically seen in FIG. 5, is connectable to the support arm 114.

Referring specifically to FIG. 5, the adjusting bracket 118 is a bent sheet of metal generally triangular in its shape. The adjusting bracket 118 has a first wall 240, a second wall 242, generally disposed transversely with respect thereto and a connecting wall 244, which connects the first and second walls 240 and 242. It is seen in FIG. 5 that the connecting wall 244 generally has at least one arcuate portion 246 extending generally beyond second wall 242.

An array of spaced apart openings 250 are formed along the arcuate portion 246 and a portion of the connecting wall 244. An opening 252 is also formed preferably at the juncture of first wall 240 and second wall 242 and an additional opening 254 is spaced from opening 252 along first wall 240.

It is noted that any other shape of the adjusting bracket 118 that enables the same functionality to be achieved is envisioned to be within the scope of the present invention.

It is particularly seen in FIGS. 4A-4C that the main support arm 114 is pivotably connected to the hitch connector 112 and is positionable at least in two different operative orientations relative thereto, preferably by means of a securing pin 116. Any other type of securing the supporting arm 114 relative to the hitch connector 112 is also within the scope of the present invention.

It is seen that the pivoting axle 224 of the support arm 114 is aligned with the first opening 212 of the fixating element 204 of hitch connector 112, thus pivotably securing the support arm 114 to the fixating element 204 and enabling pivoting of the support arm 114 about axis 225. It is seen in FIGS. 4A-4C that the support arm 114 is shown in its lowered orientation where opening 228 of the support arm 114 is not aligned with opening 214 of the fixating element 204.

According to another embodiment of the present invention, the supporting arm 114 may be connected to the fixating element 204 using a bearing or a hinge instead of fixed pivotable connection between the pivoting axle 224 of the support arm 114 and the first opening 212 of the fixating element 204 of hitch connector 112. In accordance with this embodiment of the present invention, the supporting arm 114 can pivot relative to the fixating element 204 in two different directions: lowering and raising the supporting arm 114 relative to the fixating element 204 and radially pivoting the supporting arm 114 relative to the fixating element 204 to form an angle relative to axis 223, between the supporting arm 114 and the hitch tube 126, thus urging automatic tilting of the blade assemblies 102 and 104 upon application of different loads thereon resulting from unequal forces applied along the longitudinal extent of the blade assemblies 102 and 104.

The adjusting bracket 118 is connected to the support arm 114 such that opening 252 of the adjusting bracket 118 is aligned with pivoting axle 226, thus pivotably securing the adjusting bracket 118 to the support arm 114 and enabling pivoting of the adjusting bracket 118 about axis 227. FIG. 4A-4C show the support assembly 110 in a storage orientation, in which the pivoting of the adjusting bracket 118 relative to the support arm 114 is prevented by securing the adjusting bracket 118 to support arm 114 by means of pin 120 inserted through both opening 254 of the adjusting bracket 118 and opening 230 of the support arm 114.

In accordance with another embodiment of the present invention, a guiding groove can be formed along the arcuate portion 246 of the adjusting bracket 118 and a respective guided pin formed as part of the supporting arm 114, associated with the guiding groove and displaceable therealong. This structure preferably allows continuous angular adjustment of the blade assemblies 102 and 104 relative to the supporting arm 114 upon application of varying load to the blade assemblies 102 and 104, in comparison with discrete angular adjustment of the blade assemblies 102 and 104 relative to supporting arm 114, as shown in FIGS. 4A-4C. This structure permits automatic tilting of the blade assemblies 102 and 104 in response to varying loads resulting from unequal forces applied along the longitudinal extent of the blade assemblies 102 and 104.

The connecting rod 122 is preferably pivotably connected to the adjusting bracket 118 by aligning opening 129 of the connecting rod 122 with one of the array of openings 250 of the adjusting bracket 118 and pivotably securing the connecting rod 122 and the adjusting bracket 118 by any kind of suitable fastening means, serving as a hinge extending along axis 260.

It is also noted that in this storage orientation the other side of the connecting rod 122 is secured to the holding plates 232 of the support arm 114, such that opening 125 of the connecting rod 122 is aligned with openings 234 of the holding plates 232 and a securing pin is inserted therethrough.

Reference is now made to FIGS. 8A-8D which are simplified perspective view, side plan view, top plan view and front plan view of the snowplow assembly 100 of FIGS. 1-7, shown in an open operative orientation.

It is seen in FIGS. 8A-8D that the two blade assemblies 102 and 104 are hingedly attached to each other by means of the pair of hinge brackets 106, each attached to its respective blade 150, whereas the two hinge brackets 106 are secured one to another by hinge pin 108, which is inserted through the respective bores 178 of the hinge brackets 106.

Figure 8A:
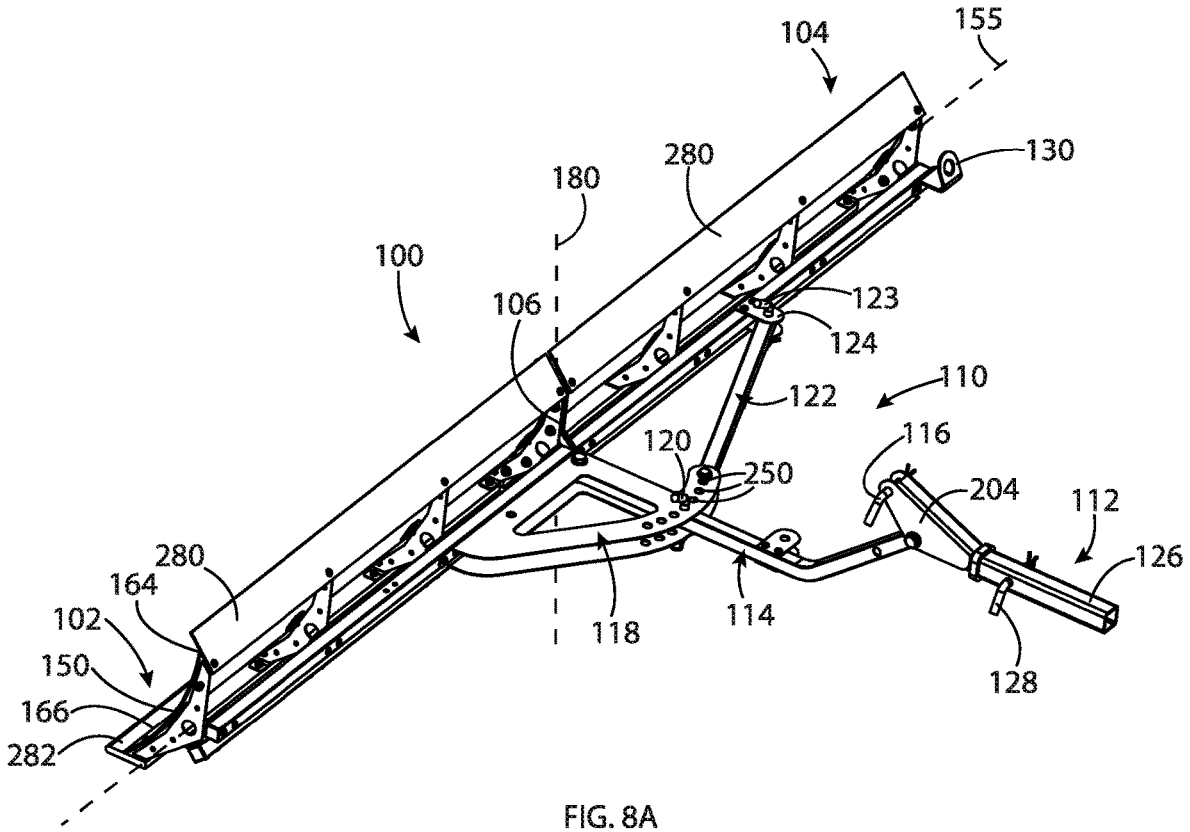
FIGS. 8A-8D are simplified perspective view, side plan view, top plan view and front plan view of the snowplow assembly of FIGS. 1-7, shown in an open operative orientation.
Figure 8B:
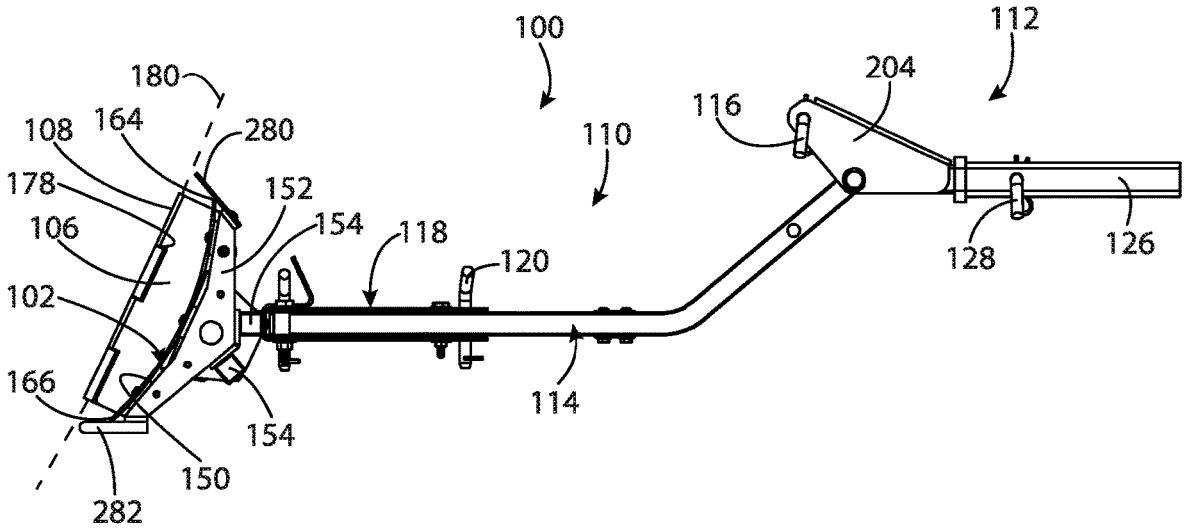
Figure 8C:
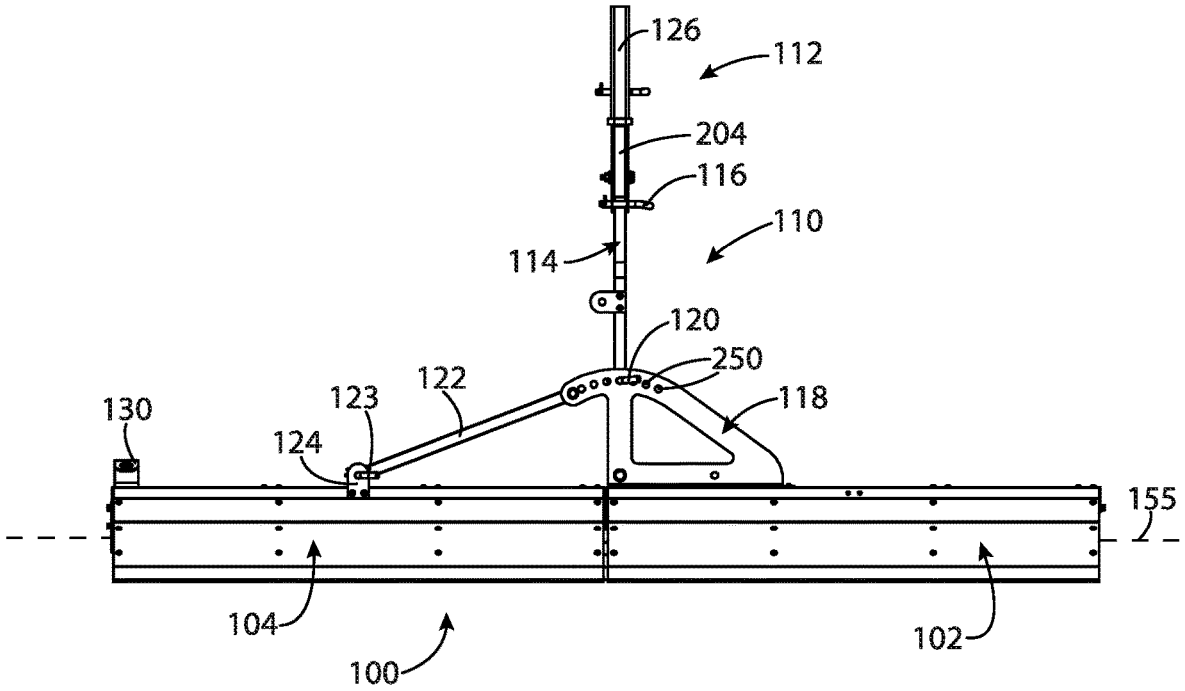
Figure 8D:
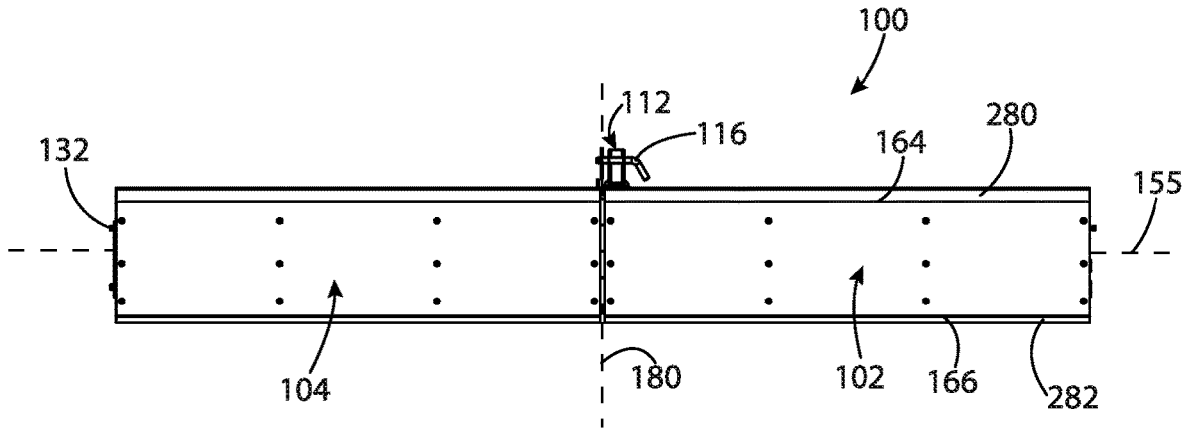

It is seen in FIGS. 8A, 8C and 8D that the first plow blade assembly 102 and the second plow blade assembly 104 extend along a single mutual longitudinal axis 155 in use, when connected to each other by the hinge brackets 106.

It is noted that the blade assemblies 102 and 104 are assembled as described and illustrated with reference to FIGS. 3A-3C. Typically, a rubber lip 280 is formed along at least a portion of the longitudinal extend of upper edge 164 of the blade 150 and a rubber lip 282 is formed along at least a portion of the longitudinal extend of lower edge 166 of the blade 150. The rubber lips 280 and 282 generally extend radially inwardly from the blade 150 and extend at an angle relative to the upper and lower edges of the blades 150. The lower rubber lip 280 is adapted for absorbing impact of obstacles on the surface and for effective plowing of the snow from the surface. The upper rubber lip 282 is adapted for effective concentration of the snow and direction thereof forwardly. It is noted that the lower rubber lip 282 preferably has a typically rounded tip. It is also noted that the rubber lips 280 and 282 are replaceable.

It is noted that alternatively, the snowplow assembly 100 may not employ rubber lips 280 and 282, rather the blades 150 may be integrally formed having a greater curvature at the upper and lower edges thereof.

It is further seen in FIGS. 8A-8C that the supporting assembly 110 is fixedly coupled to the blade assemblies 102 and 104 in this open operative orientation. It is specifically seen that the adjusting bracket 118 is fixedly attached to blade assembly 102 due to fixed connection of the first wall 240 of adjusting bracket 118 to at least one of the supporting rods 154. Any other method of fixedly connecting the adjusting bracket 118 to the first blade assembly 102 is also within the scope of the present invention.

The adjusting bracket 118 is in turn fixedly coupled to the supporting arm 114. This fixed coupling is achieved by insertion of pin 120 through one opening out of the array of openings 250 of the adjusting bracket 118 and opening 230 of the supporting arm 114.

It is a particular feature of an embodiment of the present invention that the angular positioning of the blade assemblies 102 and 104 relative to the hitch tube 126 is defined by the angular positioning between the adjusting bracket 118 and the supporting arm 114, which is in turn defined by inserting the pin 120 into a different opening out of the array of openings 250 of the adjusting bracket 118. It is noted that the blade assemblies 102 and 104 are adapted for pivoting left or right depending on the angular positioning of the adjusting bracket 118 relative to supporting arm 114.

It is seen that in FIGS. 8A-8C the main support arm 114 is positioned in the second lowered operative orientation when the securing pin 116 does not couple the support arm 114 to the fixating element 204 of the hitch connector 112.

It is a particular feature of an embodiment of the present invention that the connecting rod 122 is configured to selectably couple the support assembly 110 with the second plow blade assembly 104, thus fixating the first and second plow blade assemblies 102 and 104 relative to each other, and wherein the connecting rod 122 is configured to selectably release the second plow blade assembly 104 from the support assembly 110 to allow folding of the first plow blade assembly 102 relative to the second plow blade assembly 104 about axis 180 of the hinge brackets 106.

It is seen in FIGS. 8A, 8C and 8D that the first plow blade assembly 102 and the second plow blade assembly 104 extend along the single mutual longitudinal axis 155 when the connecting rod 122 couples the support assembly 110 with the second plow blade assembly 104.

It is seen in FIGS. 8A-8C that the connecting rod 122 fixedly connects the adjusting bracket 118 with the second blade assembly 104. Specifically, connecting rod 122 is connected at one side to the adjusting bracket 118 by fastening means insertable through aligned opening 129 of the connecting rod 122 and one opening out of the array of openings 250 of the adjusting bracket 118. Connecting rod 122 is releasably connected at another side thereof to the second blade assembly 104 by means of pin 123, insertable through holding plates 124 and bore 125 formed at the other end of the connecting rod 122. It is noted that any other method of connecting the connecting rod 122 with the adjusting bracket 118 and with the second blade assembly 104 is also within the scope of the present invention.

Figure 9:
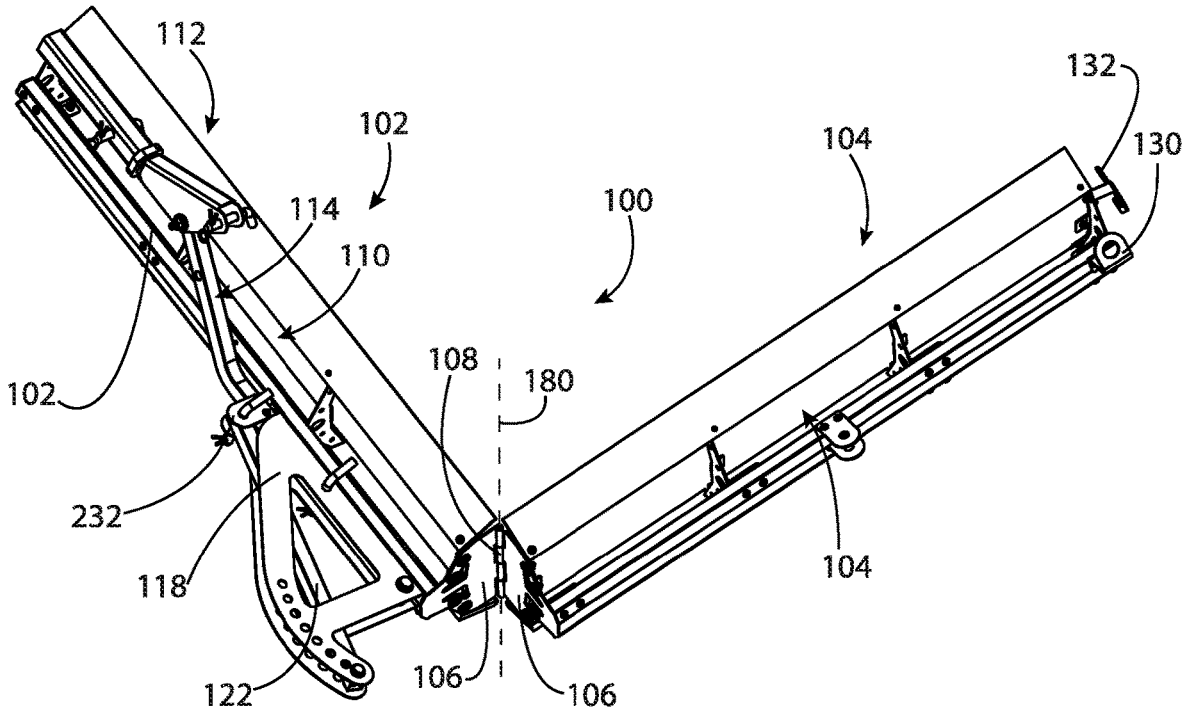
FIG. 9 is a simplified perspective view of the snowplow assembly of FIGS. 1-7, shown in a semi-folded operative orientation.
Figure 10A:
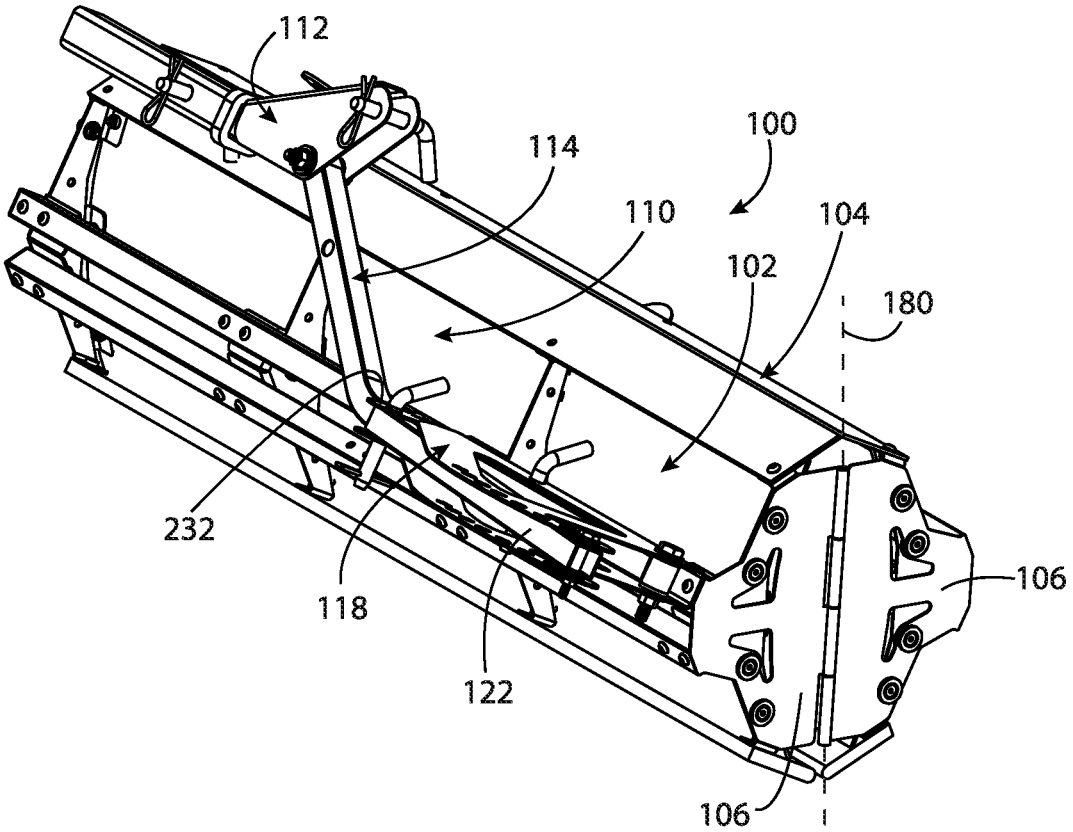
FIGS. 10A and 10B are two different simplified pictorial illustrations taken from different perspectives of the snowplow assembly of FIGS. 1-7, shown in a fully-folded operative orientation.
Figure 10B:
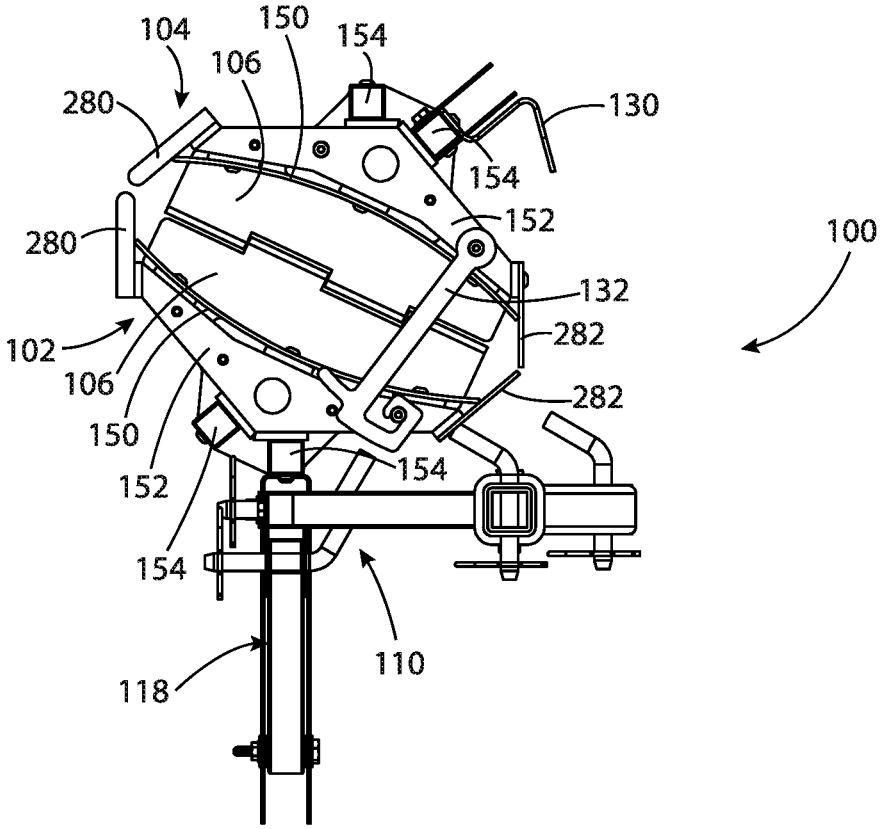

Reference is now made to FIGS. 9, which is a simplified perspective view of the snowplow assembly 100 of FIGS. 1-7, shown in a semi-folded operative orientation. Reference is additionally made to FIGS. 10A and 10B, which are two different simplified pictorial illustrations taken from different perspectives of the snowplow assembly 100 of FIGS. 1-7, shown in a fully-folded operative orientation.

It is a particular feature of an embodiment of the present invention, as seen in FIGS. 9 and 10A & 10B, that the blade assemblies 102 and 104 are adapted to be folded in half toward each other about axis 180 provided between the two hinge brackets 106 upon release of the connecting rod 122 from the blade assembly 104.

FIG. 9 shows the snowplow assembly 100 is a semi-folded operative orientation. The pin 123 is removed from opening 125 of the connecting rod 122, thus releasing the connecting rod 122 and allowing pivotable displacement between the two blade assemblies 102 and 104.

It is noted that once the connecting rod 122 is released, it can be secured to the holding plates 232 of the supporting arm 114 by insertion of a pin through opening 125 in the connecting rod and opening 234 formed in the holding plate 232.

It is particularly seen in FIGS. 10A and 10B that the two blade assemblies 102 and 104 are fully folded over each other, such that the forwardly facing surfaces 162 of the respective blade assemblies 102 and 104 are facing each other and the two hinge brackets 106 are preferably coplanar in this fully-folded operative orientation.

It is noted that the supporting assembly 110 is disposed in this operative orientation in the orientation that is illustrated and described with reference to FIGS. 4A-4C.

It is specifically seen in FIG. 10B that latch 132 is configured for latching the two blade assemblies 102 and 104 together in this fully-folded operative orientation to provide for easy storage of the snowplow assembly 100 when not in use.

Figure 11:
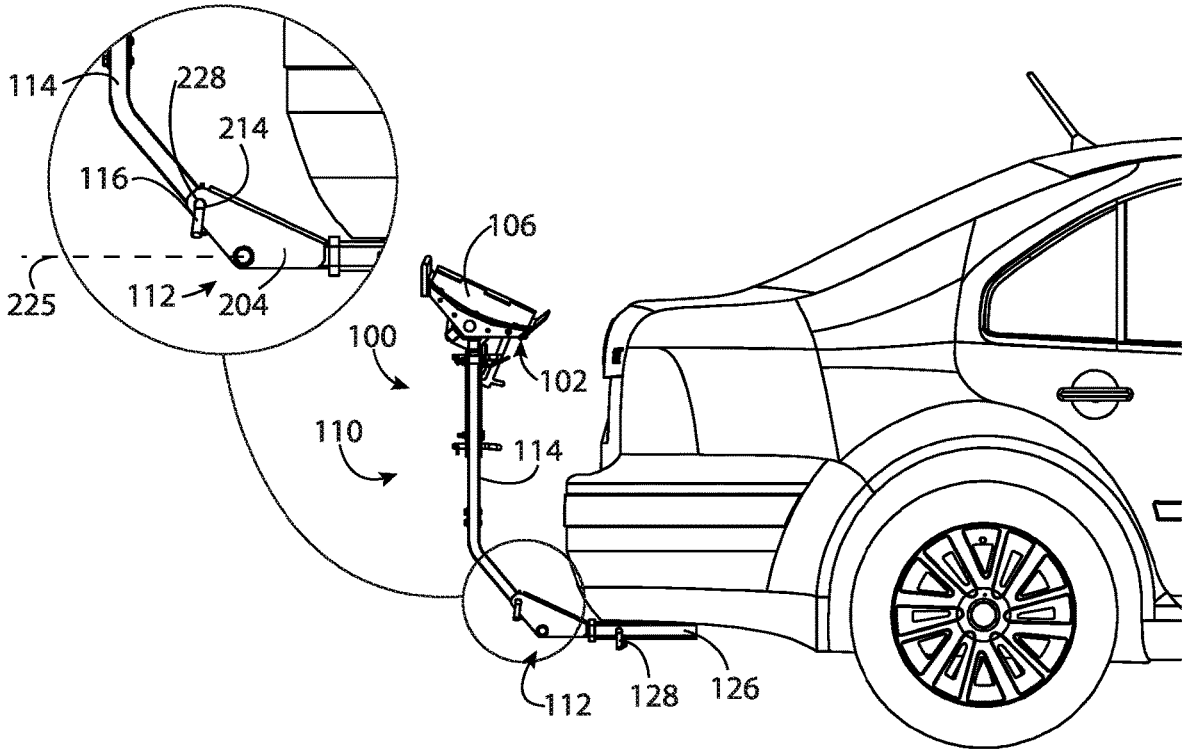
FIG. 11 is a simplified side plan view illustration of the snowplow assembly of FIG. 1-7 mounted onto a vehicle and shown in a raised operative orientation.

Reference is now made to FIG. 11, which is a simplified side plan view illustration of the snowplow assembly 100 of FIG. 1-7 mounted onto a vehicle and shown in a raised operative orientation.

It is seen in FIG. 11 that while not in use, the snowplow assembly 100 may be raised above the ground and fixed in an upright position. In this raised operative orientation, the supporting arm 114 is pivotably displaced upwardly relative to the fixating element 204 of the hitch connector 112 about axis 225 up to alignment or opening 228 of the supporting arm 114 with opening 214 of the fixating element 204 and secured in this raised orientation by pin 116. In this operative orientation, the snowplow assembly 100 does not interfere with normal operation of the vehicle.

Figure 12:
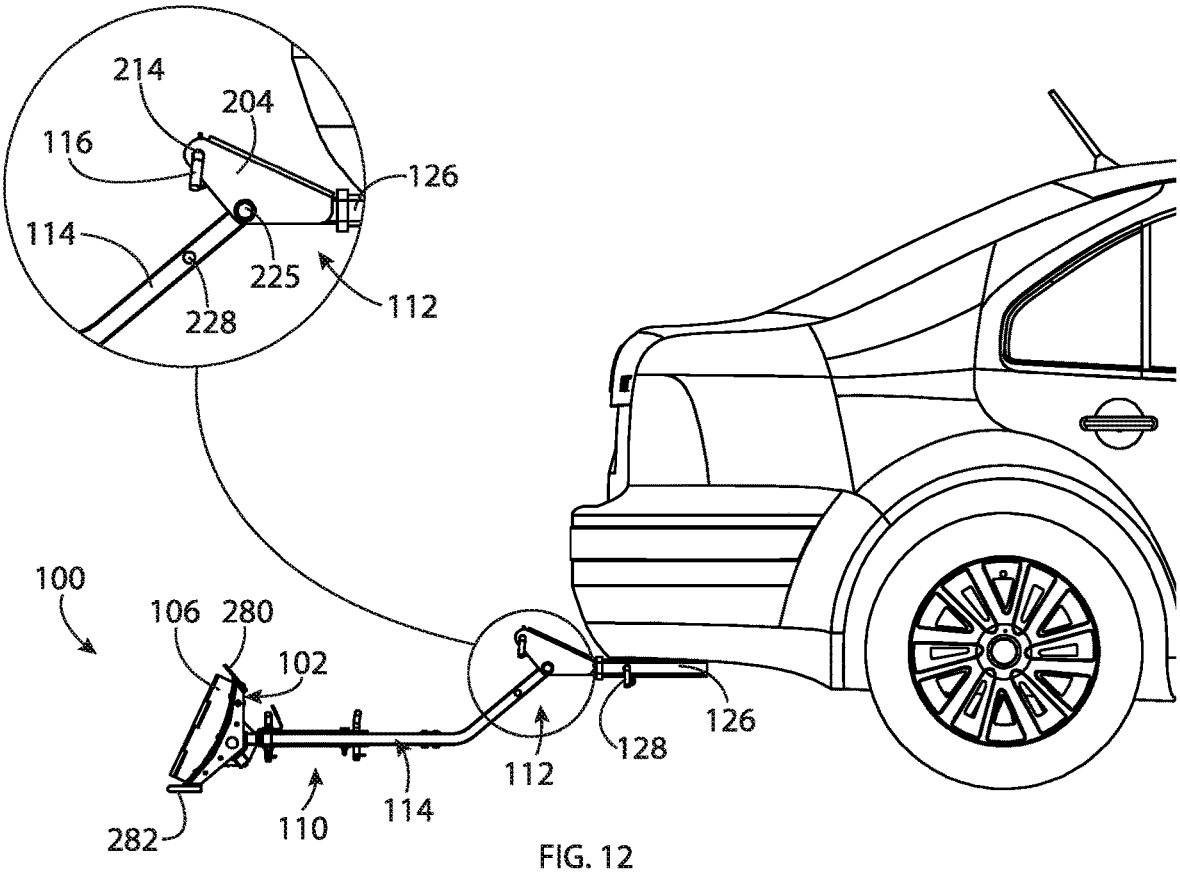
FIG. 12 is a simplified side plan view illustration of the snowplow assembly of FIG. 1-7 mounted onto a vehicle and shown in a lowered operative orientation.

Reference is now made to FIG. 12, which is a simplified side plan view illustration of the snowplow assembly 100 of FIG. 1-7 mounted onto a vehicle and shown in a lowered operative orientation.

It is seen in FIG. 12 that while in use, the snowplow assembly 100 may be lowered to the surface of the ground to facilitate snow removal therefrom. The snowplow assembly 100 is lowered by removing pin 116 and thus releasing the supporting arm 114 to be pivotably lowered to the ground due to gravity. In this lowered operative orientation, the supporting arm 114 is pivotably displaced downwardly relative to the fixating element 204 of the hitch connector 112 about axis 225 up to engagement of the lower rubber lip 282 with the ground. In this operative orientation, the snowplow assembly 100 is configured for plowing snow from the ground.

In accordance with another embodiment of the present invention, the supporting arm 114 is held in the lowered position relative to the hitch connector 112 by means of a biasing force pushing the supporting arm 114 downwardly, such as for example a torsion spring mounted onto pivoting axle 224 of the supporting arm. Alternatively, a compression spring may be mounted between the fixating element 204 and the supporting arm 114, thus urging downward pivoting displacement of the supporting arm 114 upon release of the pin 116 therefrom. Further alternatively, a tension spring may be mounted between the supporting arm 114 and the hinge tube 126.

It is appreciated that any other suitable biasing mechanism ensuring lowering of the supporting arm 114 to the ground is conceived to be part of the present invention.

Figure 13:
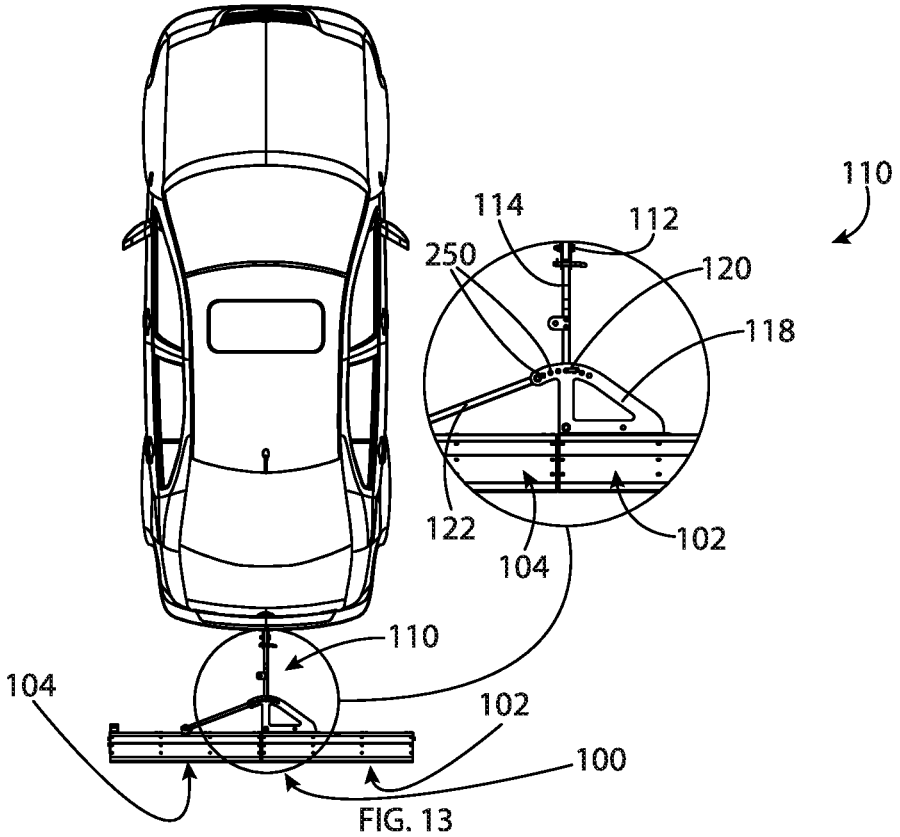
FIG. 13 is a simplified top plan view illustration of the snowplow assembly of FIGS. 1-7 mounted onto a vehicle and shown in a straight orientation.

Reference is now made to FIG. 13, which is a simplified top plan view illustration of the snowplow assembly 100 of FIGS. 1-7 mounted onto a vehicle and shown in a straight orientation.

It is seen that the snowplow assembly 100 is positioned in a straight orientation relative to the vehicle when the adjusting bracket 118 is pivoted accordingly relative to the supporting arm 114 and secured in this orientation by inserting pin 120 through the intermediate opening out of the array of openings 250 formed in the adjusting bracket 118 and through opening 230 of the supporting arm 114.

It is seen that in this straight operative orientation the blade assemblies 102 and 104 are both disposed generally perpendicularly relative to the supporting arm 114, whereas the first plow blade assembly 102 and the second plow blade assembly 104 extend along a single mutual longitudinal axis 155 when connected to each other by the hinge brackets 106.

Figure 14:
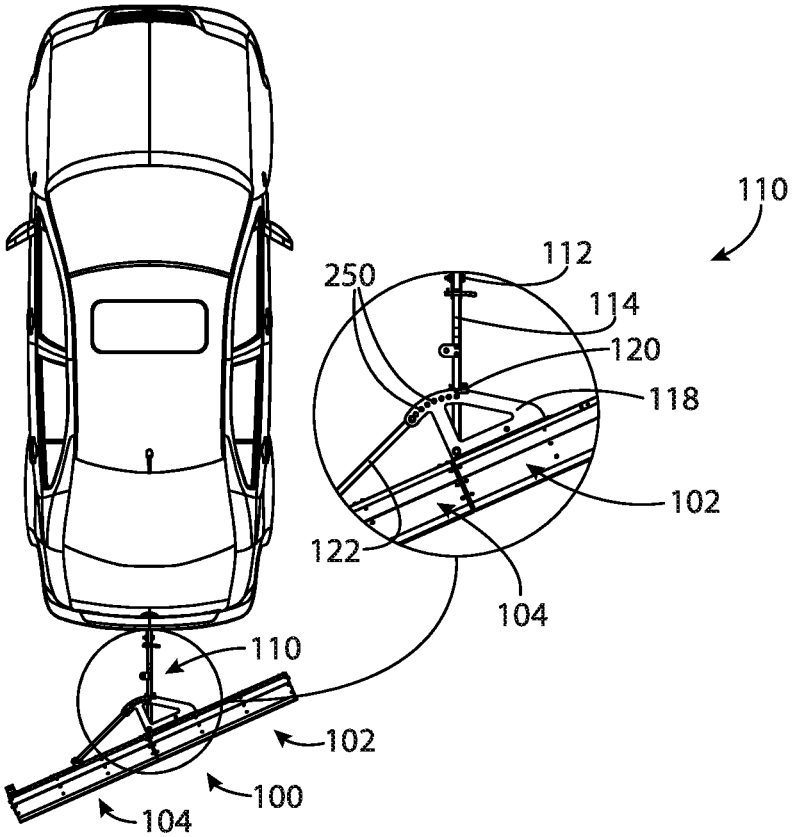
FIG. 14 is a simplified top plan view illustration of the snowplow assembly of FIGS. 1-7 mounted onto a vehicle and shown in a first tilted orientation.

Reference is now made to FIG. 14, which is a simplified top plan view illustration of the snowplow assembly 100 of FIGS. 1-7 mounted onto a vehicle and shown in a first tilted orientation.

It is seen that in this tilted to the right operative orientation the blade assemblies 102 and 104 are both disposed generally at an angle "a" relative to the straight orientation. In this position, the blade assemblies 102 and 104 are disposed at an angle with respect to the supporting arm 114, whereas the first plow blade assembly 102 and the second plow blade assembly 104 extend along a single mutual longitudinal axis 155.

It is noted that the angular adjustment of both of the blade assemblies 102 and 104 relative to the supporting arm 114 is provided by pivoting the adjusting bracket 118 about axis 227 to the desired angular orientation relative to the supporting arm 114 and securing the bracket 118 in this orientation by inserting pin 120 through one of the lefthand openings out of the array of openings 250 formed in the adjusting bracket 118 and through opening 230 of the supporting arm 114.

It is noted that the angle "a" can be within any range of angles.

Figure 15:
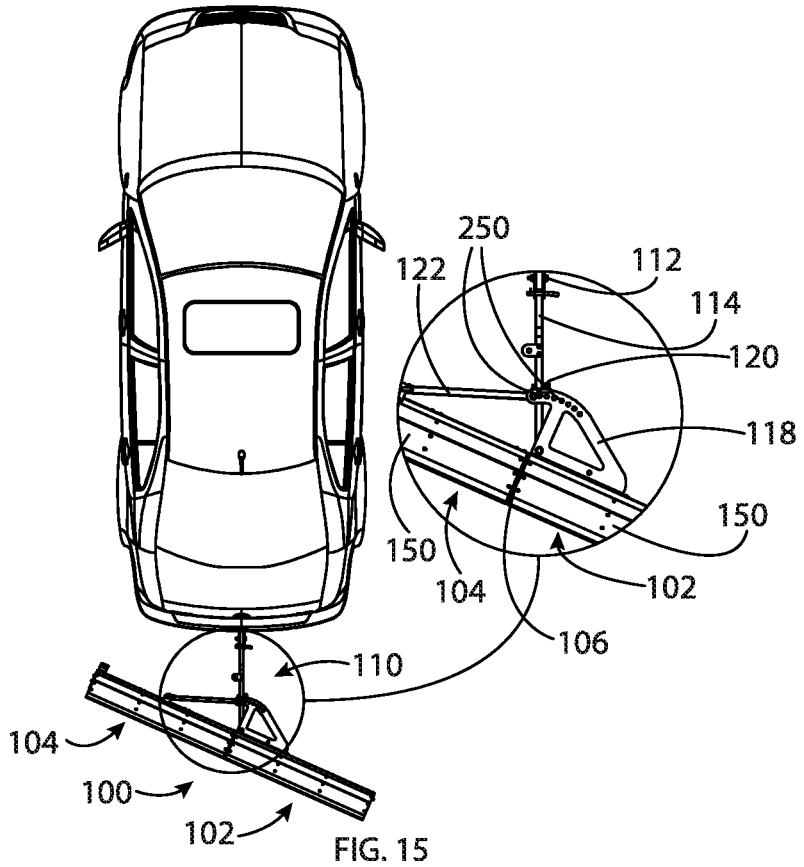
FIG. 15 is a simplified top plan view illustration of the snowplow assembly of FIGS. 1-7 mounted onto a vehicle and shown in a second tilted orientation.

Reference is now made to FIG. 15, which is a simplified top plan view illustration of the snowplow assembly 100 of FIGS. 1-7 mounted onto a vehicle and shown in a second tilted orientation.

It is seen that in this tilted to the left operative orientation the blade assemblies 102 and 104 are both disposed generally at an angle "b" relative to the straight orientation. In this position, the blade assemblies 102 and 104 are disposed at an angle with respect to the supporting arm 114, whereas the first plow blade assembly 102 and the second plow blade assembly 104 extend along a single mutual longitudinal axis 155.

It is noted that the angular adjustment of both of the blade assemblies 102 and 104 relative to the supporting arm 114 is provided by pivoting the adjusting bracket 118 about axis 227 to the desired angular orientation relative to the supporting arm 114 and securing the bracket 118 in this orientation by inserting pin 120 through one of the righthand openings out of the array of openings 250 formed in the adjusting bracket 118 and through opening 230 of the supporting arm 114.

It is noted that the angle "a" can be within any range of angles.

Figure 16:
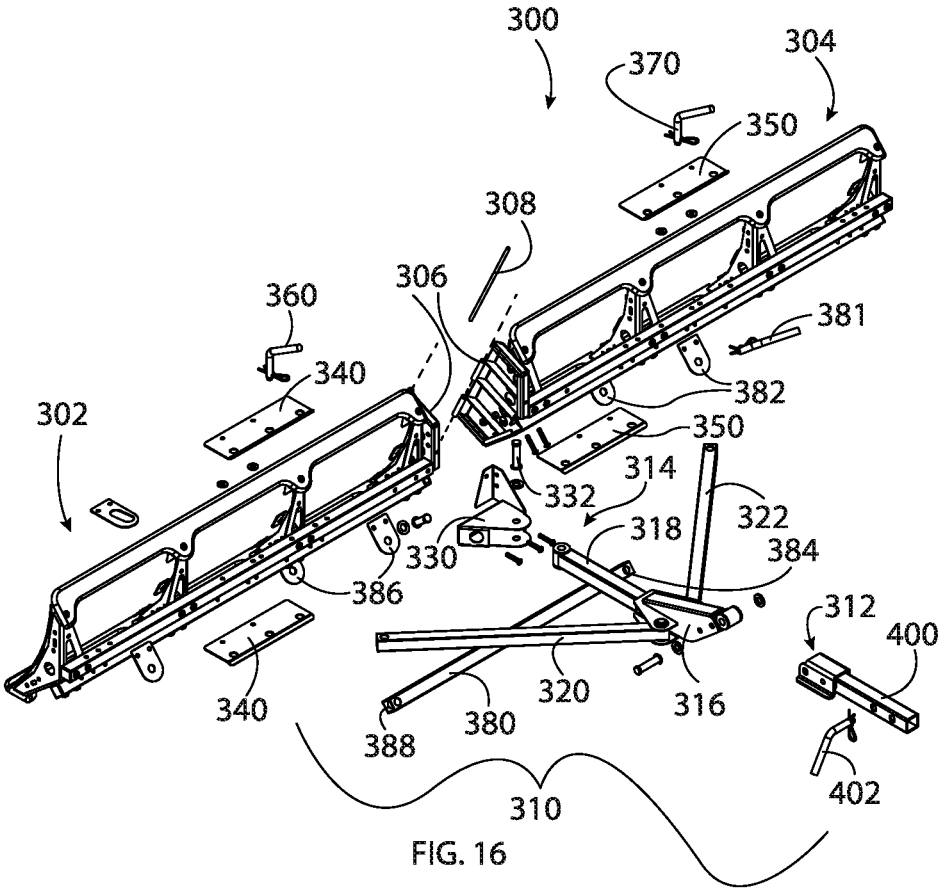
FIG. 16 is a simplified exploded view illustration of a snowplow assembly constructed and operative in accordance with another embodiment of the present invention.

Reference is now made to FIG. 16, which is a simplified exploded view illustration of a snowplow assembly constructed and operative in accordance with another embodiment of the present invention.

A snowplow assembly 300 is seen in FIG. 16, which preferably includes a first plow blade assembly 302 and a second plow blade assembly 304, which are adapted to be connected to each other by a pair of hinge brackets 306 intermeshed with each other. A hinge pin 308 is configured to be insertable through a bore formed by the pair of hinge brackets 306. The first plow blade assembly 302 and a second plow blade assembly 304 are configured to extend along a mutual longitudinal axis when connected to each other by the hinge brackets 306.

It is also seen in FIG. 16 that a vehicle connector and support assembly 310 is adapted to be connected to a hitch of a vehicle and to both the first plow blade portion 302 and to the second plow blade assembly 304.

The support assembly 310 preferably comprises a hitch connector 312 and a main support arm assembly 314, which is preferably selectably pivotably connectable to the hitch connector 312.

It is a particular feature of an embodiment of the present invention that the main support arm assembly 314 preferably includes a base portion 316 and a first arm 318, a second arm 320 and a third arm 322 extending therefrom. The three arms 318, 320 and 322 are configured to be coupled to the first and second plow assemblies 302 and 304 at one side thereof and to the base portion 316 at another side thereof.

A connecting bracket 330 is fixedly connectable to the first plow blade assembly 302. The connecting bracket 330 is also selectably fixedly connectable to the first arm 318 by means of a pin 332.

A first adjusting bracket 340 is fixedly connectable to the first plow blade assembly 302 and a second adjusting bracket 350 is fixedly connectable to the second plow blade assembly 304.

It is a particular feature of an embodiment of the present invention that the relative angular orientation between both plow blade assemblies 302 and 304 and between the first arm 318 is configured to be adjusted by changing the position of a securing pin 360 within the first adjusting bracket 340, thus fixating a certain angular positioning of the first and second plow assemblies 302 and 304 relative to the first arm 318 and/or changing the position of a securing pin 370 within the second adjusting bracket 350, thus fixating a certain angular positioning of the first and second plow assemblies 302 and 304 relative to the first arm 318. A certain angular positioning of the first and second plow assemblies 302 and 304 relative to the first arm 318 is defined by the positioning of the second arm 320 relative to the first adjusting bracket 340 and by the positioning of the third arm 322 relative to the second adjusting bracket 350.

It is a particular feature of an embodiment of the present invention that a connecting rod 380 is configured to selectably couple the first plow blade assembly 302 and the second plow blade assembly 304, thus fixating the first and second plow blade assemblies 302 and 304 relative to each other, and wherein the connecting rod 380 is configured to be selectably released from either the first plow blade assembly 302 or the second plow blade assembly 304 to allow folding of the first plow blade assembly 302 relative to the second plow blade assembly 304 about the hinge brackets 306.

In accordance with an embodiment of the present invention, the connecting rod 380 is adapted to be connected to the second plow blade assembly 304 by means of a securing pin 381 inserted through a holding plate 382 attached to the second plow blade assembly 304 and through an opening 384 formed at one side of the connecting rod 380. The holding plate 382 is adapted to be fixedly releasably secured to the second plow blade assembly 304. The connecting rod 380 is adapted to be further pivotably connected to the first plow blade assembly 302 by means of a fastener inserted through a holding plate 386 attached to the first plow blade assembly 302 and through an opening 388 formed at another side of the connecting rod 380. The holding plate 386 is adapted to be fixedly secured to the first plow blade assembly 302. It is noted that alternatively any other suitable connecting means operative to selectively connect the connecting rod 380 to either the first plow blade assembly 302 or the second plow blade assembly 304 are within the scope of the present invention.

It is noted that the hitch connector 312 may be attached to a hitch tube 400, which is connected to the frame of the vehicle, by means of pin 402. Alternatively, any other fastening means can be employed to secure the hitch connector 312 to the hitch tube 400.

Figure 17:
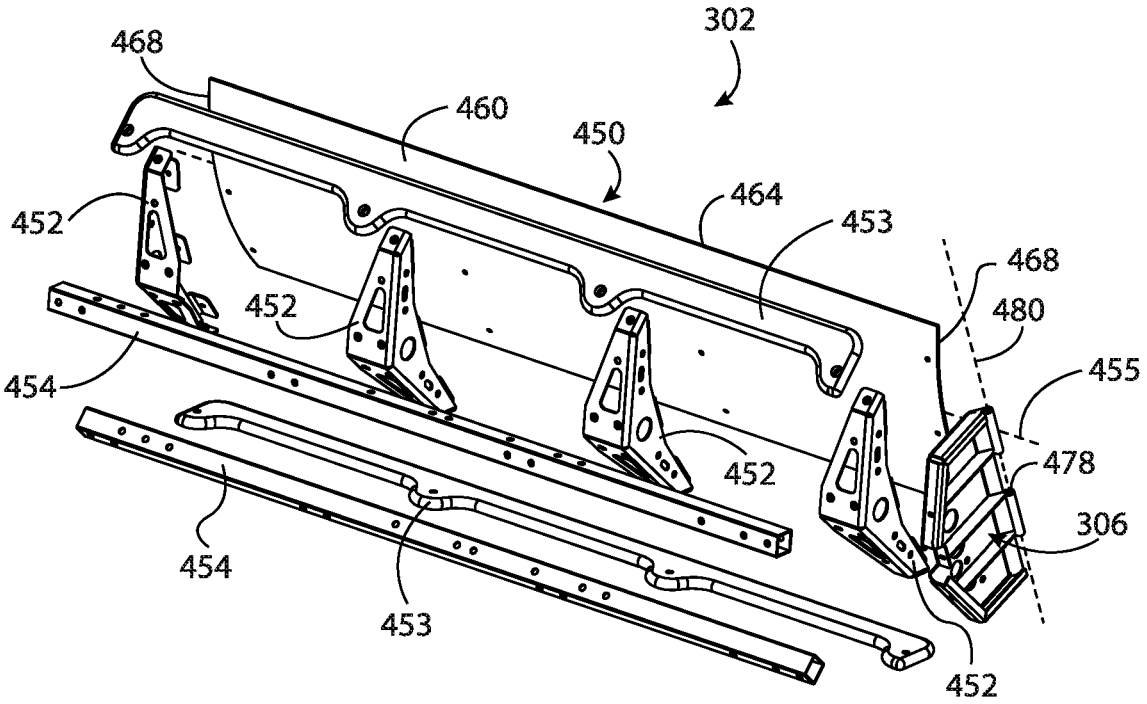
FIG. 17 is a simplified exploded view illustration of a snowplow blade assembly forming part of the snowplow assembly of FIG. 16.
Figure 18A:
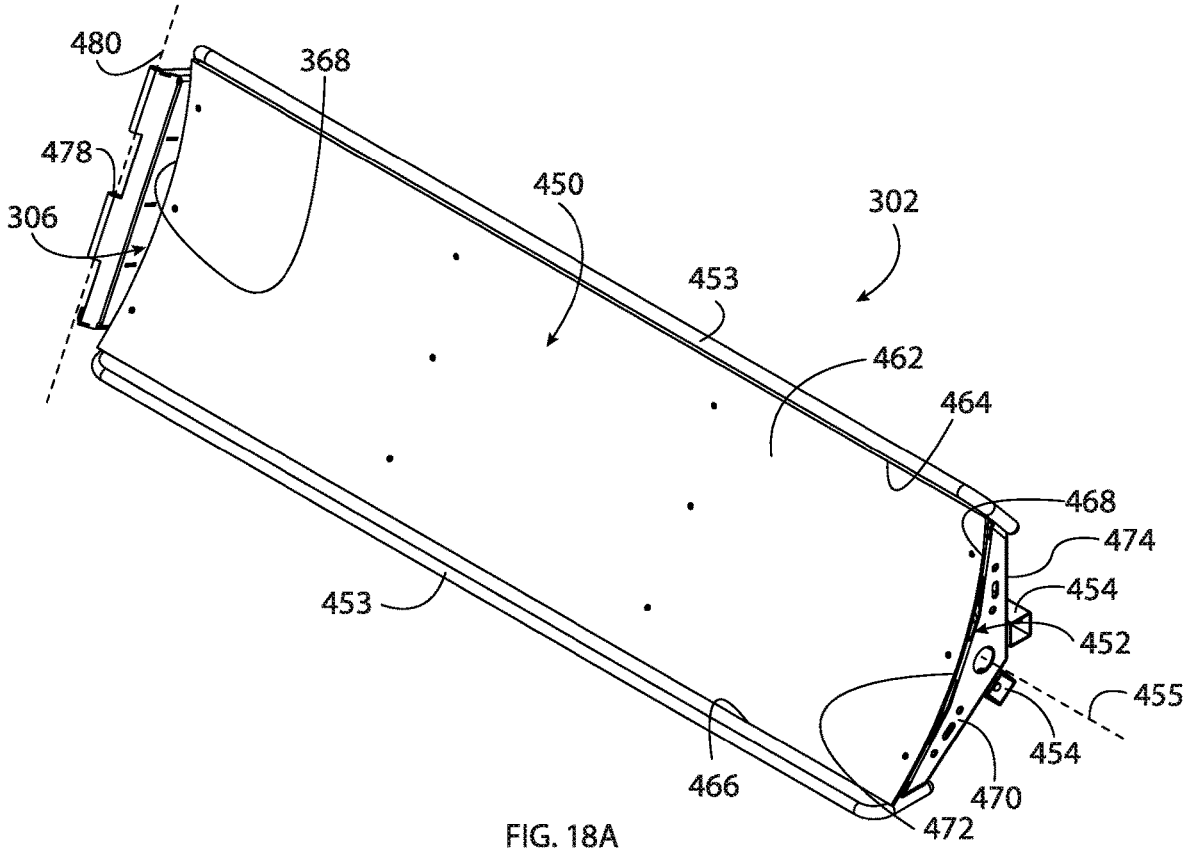
FIGS. 18A-18C are simplified assembled perspective view, rear plan view and side plan view of the snowplow blade assembly of FIG. 17.
Figure 18B:
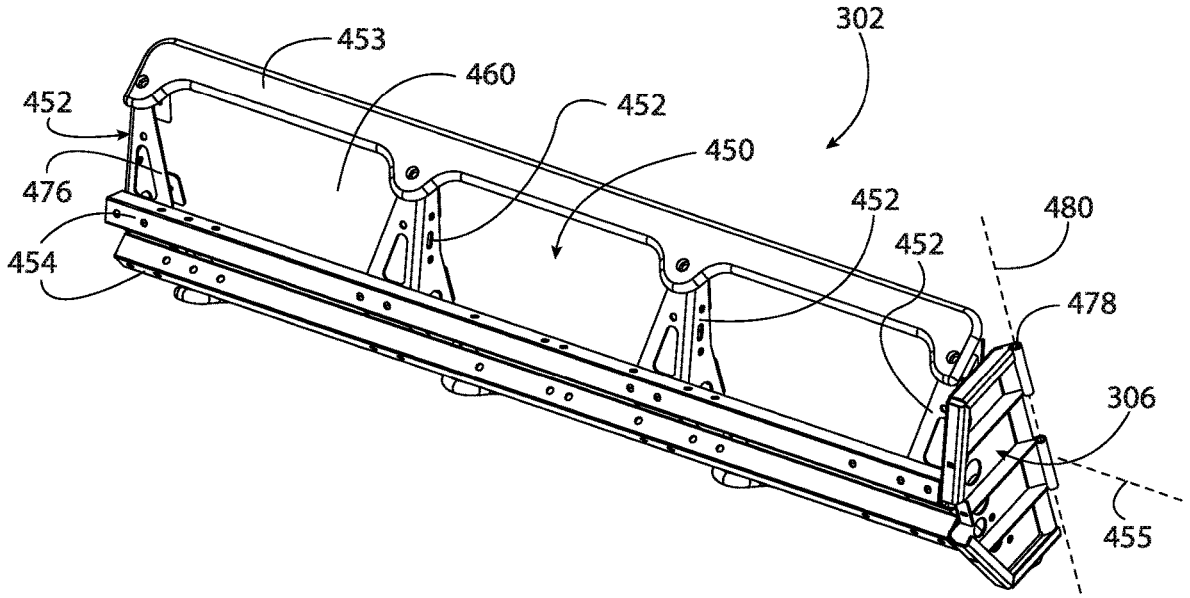
Figure 18C:
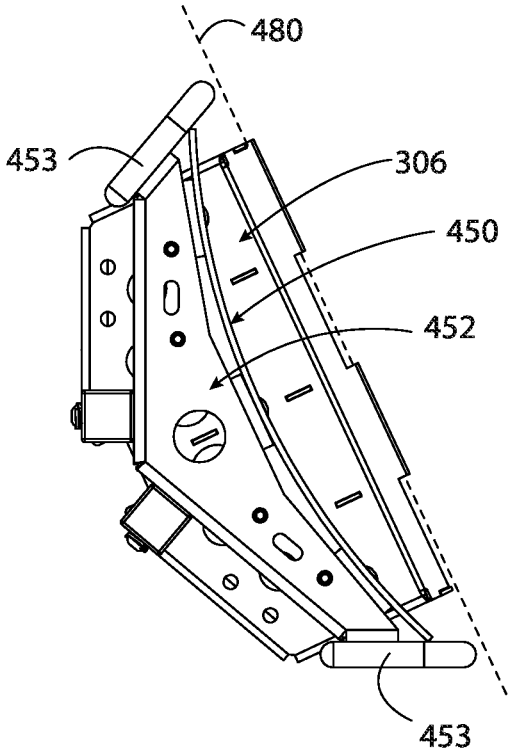

Reference is now made to FIG. 17, which is a simplified exploded view illustration of the plow blade assembly forming part of the snowplow assembly 300 of FIG. 16. Reference is additionally made to FIGS. 18A-18C, which are simplified assembled perspective view, rear plan view and side plan view of the snowplow blade assembly of FIG. 17.

It is appreciated that the first plow blade assembly 102 and the second plow blade assembly 104 are generally identical.

Referring specifically to FIG. 17, it is seen that the first plow blade assembly 302 preferably includes a blade 450, a plurality of holding brackets 452 configured to be attached to the blade 450 and typically two bounding rods 453 and typically two support rods 454, configured to be attached to the holding brackets 452. The hinge brackets 306 are attachable between the two plow blade assemblies 302 and 304.

It is noted that the blade 450 is a generally integrally formed element, generally made of a relatively resilient plastic and arranged along longitudinal axis 455. Once the holding brackets 452 are fixed to the blades 450, the blades 450 are curved to form a generally convex rearwardly facing surface 460 and a generally concave forwardly facing surface 462. The blade 450 defines an upper edge 464, a lower edge 466 and two mutually opposed side edges 468.

The holding brackets 452 are generally integrally formed and generally made of metal and adapted to support the blade 450. The holding brackets 452 preferably have a generally triangular base wall 470 defining a curved edge 472, adapted to conform with the rearwardly facing surface 460 of the blade and typically two generally straight edges 474. A protrusion 476 preferably extends from each of straight edges 474 and is arranged transversely with respect to base wall 470. Protrusions 476 are adapted for fixed connection with supporting rods 454. Bounding rods 453 are adapted for fixed connection with the upper and lower edges 464 and 466 of the blade 450.

Each of the supporting rods 454 is a generally hollow longitudinal integrally made element.

It is noted that any other suitable connecting means adapted for fixedly supporting the blade assemblies 302 and 304 and connect them to the support assembly 310 are within the scope of the present invention.

The hinge bracket 306 preferably includes a through bore 478 arranged along an axis 480, which extends generally transversely with respect to longitudinal axis 455.

Referring now specifically to FIGS. 18A-18C, it is seen that the holding brackets 452 are fixedly connected to the blade 450, such that the curved edge 472 is generally disposed adjacent the rearwardly facing surface 460. The supporting rods 454 are fixedly attached to protrusions 476 of the holding brackets 452. The hinge brackets 306 are fixedly attached to the respective base wall 470 of the holding bracket 452 that is disposed adjacent one of the side edges 468 of the blade 450 and is preferably also attached to an end of the supporting rod 454, that is disposed adjacent the same holding bracket 452.

It is noted that the hinge bracket 306 is attached to the blade 450 such that the through bore 478 thereof defining axis 480 is disposed forwardly of the forwardly facing surface 462 of blade 450.

Bounding rods 453 are fixedly connected to the upper and lower edges 464 and 466 of the blade 450 and preferably extend forwardly from the forwardly facing surface 462 of blade 450. It is noted that the bounding rods 453 preferably extend at an angle relative to the forwardly facing surface 462 of the blade 450.

Figure 19A:
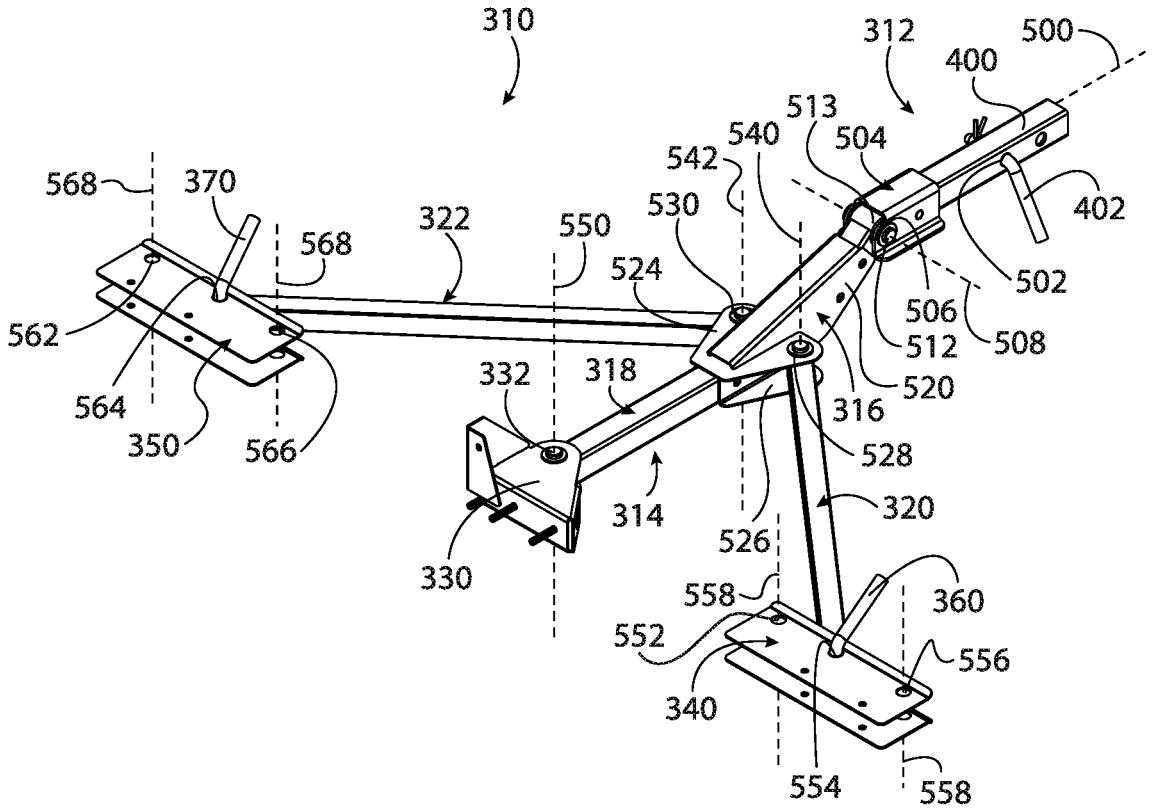
FIGS. 19A-19C are simplified assembled perspective view, side plan view and top plan view of a vehicle connector and supporting assembly, forming part of the snowplow assembly of FIG. 16.
Figure 19B:
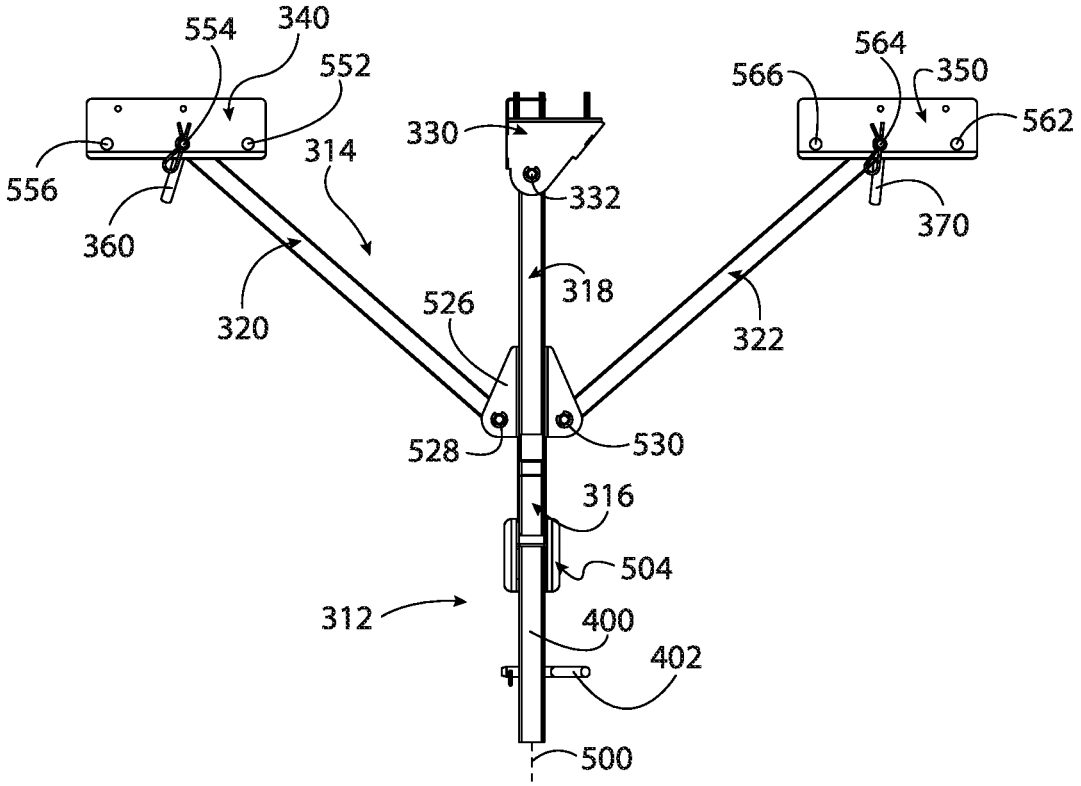
Figure 19C:
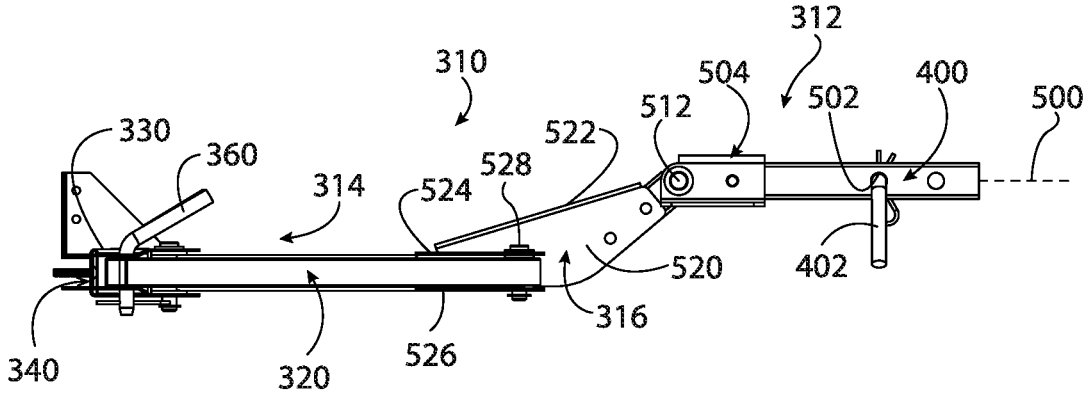
Figure 20:
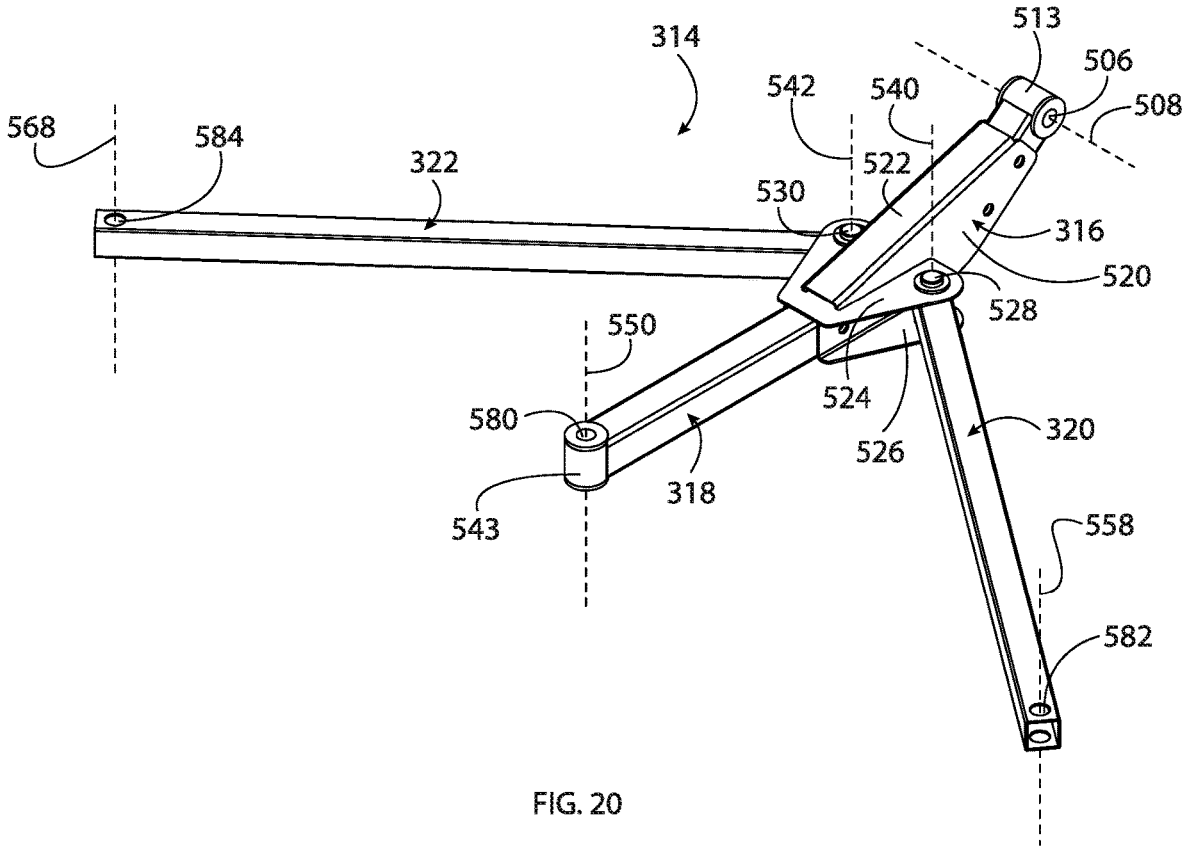
FIG. 20 is a simplified perspective view of a supporting arm assembly, forming part of the vehicle connector and supporting assembly of FIGS. 19A-19C.

Reference is now made to FIGS. 19A-19C, which are simplified assembled perspective view, side plan view and top plan view of the vehicle connector and supporting assembly 310, forming part of the snowplow assembly 300 of FIG. 16 Reference is additionally made to FIG. 20, which is a simplified perspective view of the supporting arm assembly 314, forming part of the vehicle connector and supporting assembly 310 of FIGS. 19A-19C.

The supporting assembly 310 includes the hitch connector 312. It is seen that the hitch connector 312 has the hitch tube 400 extending along longitudinal axis 500. Preferably, a bore 502 is formed in the hitch tube 400 and typically extends transversely with respect to the tube 400. The hitch connector 312 has a preferably wider forward portion 504 forming part of the tube 400 and having a bore 506 formed therethrough and extending along axis 508, which extends transversely with respect to longitudinal axis 500.

The supporting assembly 310 additionally includes the base portion 316. The base portion 316 may be generally attached to the hitch tube 400 in a telescoping manner and attached thereto by means of pin 402 being inserted through bore 502.

The base portion 316 is preferably pivotably attached to the forward portion 504 of the hitch connector 312 by means of a fastener 512, which is inserted through the pivot axle 513 forming part of the base portion 316 and extending along axis 508. The fastener 512 is inserted into bore 506 formed through the pivot axle 513. The base portion 316 is pivotable relative to the forward portion 504 about axis 508.

Alternatively, the base portion 316 and the hitch tube 400 may be integrally formed.

It is noted that both the hitch tube 400 and the base portion 316 are preferably made of metal. The hitch tube 400 is hollow and the base portion 316 is a bent sheet of metal, both designed to be light-weight.

The base portion 316 has typically two mutually facing side walls 520 connected by a connecting wall 522. A first flange 524 extends outwardly from each one of the side walls 520 and forwardly from the connecting wall 522 of the base portion 316 and is fixedly connected or integrally formed at an intermediate location of the side walls 520. A second flange 526 is disposed in parallel to the first flange 524 and slightly downwardly spaced therefrom. A through bore 528 is formed on one side of both the first and second flanges 524 and 526. A through bore 530 is formed on another side of both the first and second flanges 524 and 526. It is noted that through bore 528 extends along axis 540, extending transversely to axis 508. Through bore 530 extends along axis 542, extending transversely to axis 502.

It is seen in FIGS. 19A-19C and in FIG. 20 that the main support arm assembly 314, which is particularly seen in FIG. 20 is preferably fixedly connected to the base portion 316.

As mentioned hereinabove, the main support arm assembly 314 preferably includes base portion 316 and first arm 318, second arm 320 and third arm 322 extending therefrom, each in a different angular direction. The first, second and third arms 318, 320 and 322 are generally hollow longitudinal elements.

Connecting bracket 330 is selectably pivotably connectable to the forward end of the first arm 318 by means of pin 332 inserted into a pivot axle 543, extending along axis 550, which extends generally in parallel to axes 540 and 542. The first arm 318 is fixedly connected to the base portion 316 at the rearward end thereof.

The first adjusting bracket 340 preferably has a plurality of openings, typically three openings 552, 554 and 556, extending along axes 558, which extend generally in parallel to axis 550. Securing pin 360 is configured to be selectively inserted into one of the three openings 552, 554 and 556 of the first adjusting bracket 340 and thus the forward end of the second arm 320 is selectively fixedly connected to the first adjusting bracket 340 and the rearward end of the second arm 320 is fixedly connected to the base portion 316.

The second adjusting bracket 350 preferably has a plurality of openings, typically three openings 562, 564 and 566, extending along axes 568, which extend generally in parallel to axis 550. Securing pin 370 is configured to be selectively inserted into one of the three openings 562, 564 and 566 of the second adjusting bracket 350 and thus the forward end of the third arm 322 is selectively fixedly connected to the second adjusting bracket 350 and the rearward end of the third arm 322 is fixedly connected to the base portion 316.

It is particularly seen in FIG. 20 that the first arm 318 has an opening 580 formed within the pivot axle 543, which is located generally at the forward end of the first arm 318. The opening 580 extends along axis 550 and adapted for insertion of pin 332 for pivotably attaching the connecting bracket 330 to the forward end of the first arm 318. The second arm 320 has an opening 582 at the forward end thereof. The opening 582 extends along axis 558 and adapted for insertion of securing pin 360 for selectively fixedly attaching the first adjusting bracket 340 to the forward end of the second arm 320. The third arm 322 has an opening 584 at the forward end thereof. The opening 584 extends along axis 568 and adapted for insertion of securing pin 370 for selectively fixedly attaching the second adjusting bracket 350 to the forward end of the third arm 322.

According to another embodiment of the present invention, the supporting arm assembly 314 may be connected to the hitch connector 312 using a bearing or a hinge instead of fixed pivotable connection between the pivot axle 513 of the support arm assembly 514 and the bore 506. In accordance with this embodiment of the present invention, the supporting arm assembly 314 can pivot relative to the hitch connector 312 in two different directions: lowering and raising the supporting arm assembly 314 relative to the hitch connector 312.

Reference is now made to FIGS. 21A-21D, which are simplified perspective view, side plan view, top plan view and front plan view of the snowplow assembly 300 of FIGS. 16-20, shown in an open operative orientation.

It is seen in FIGS. 21A-21D that the two blade assemblies 302 and 304 are hingedly attached to each other by means of the pair of hinge brackets 306, each attached to its respective blade 450, whereas the two hinge brackets 306 are secured one to another by hinge pin 308, which is inserted through the respective bores 478 of the hinge brackets 306.

Figure 21A:
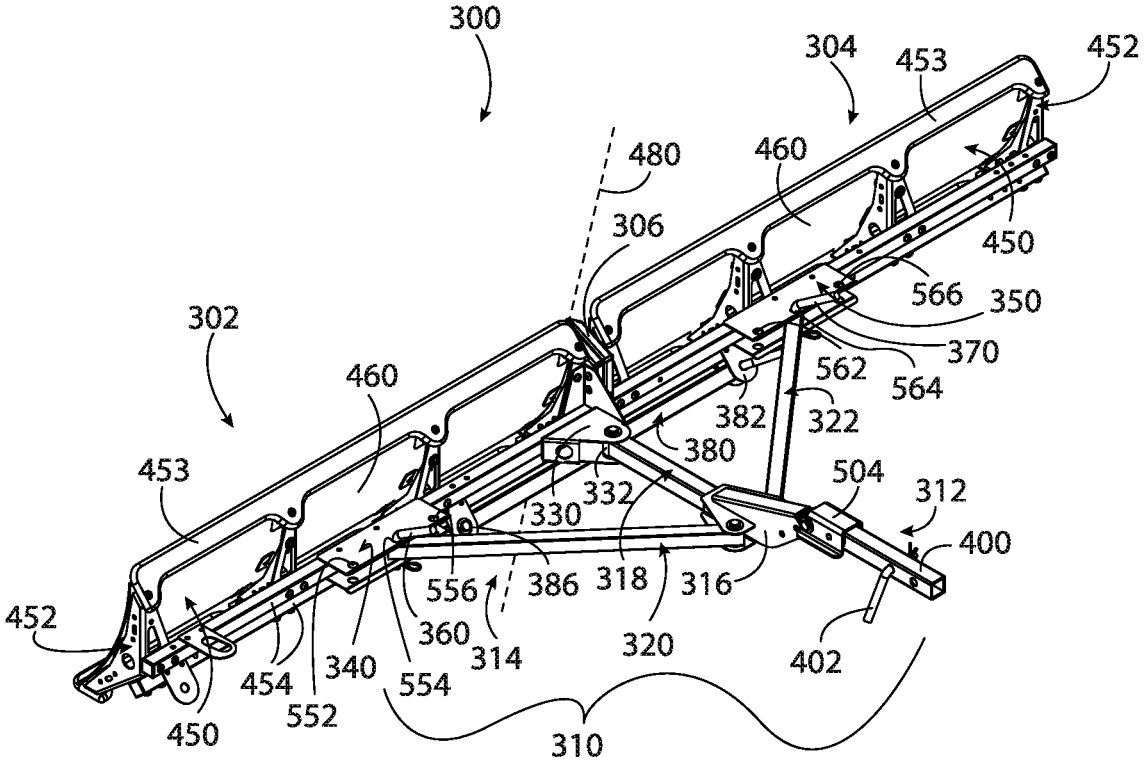
FIGS. 21A-21D are simplified perspective view, side plan view, top plan view and front plan view of the snowplow assembly of FIGS. 16-20, shown in an open operative orientation.
Figure 21B:
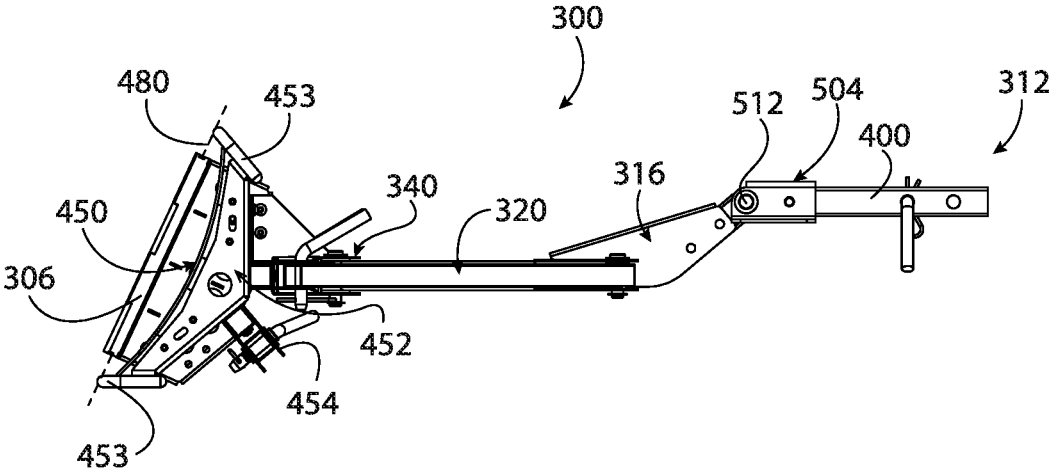
Figure 21C:
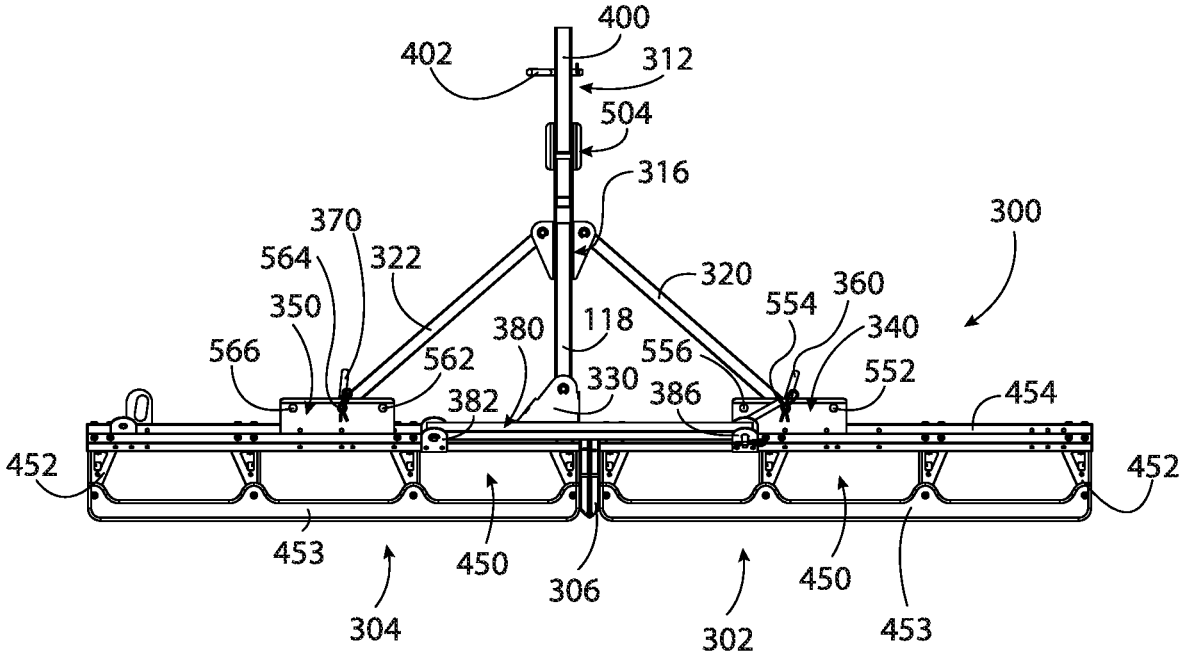
Figure 21D:
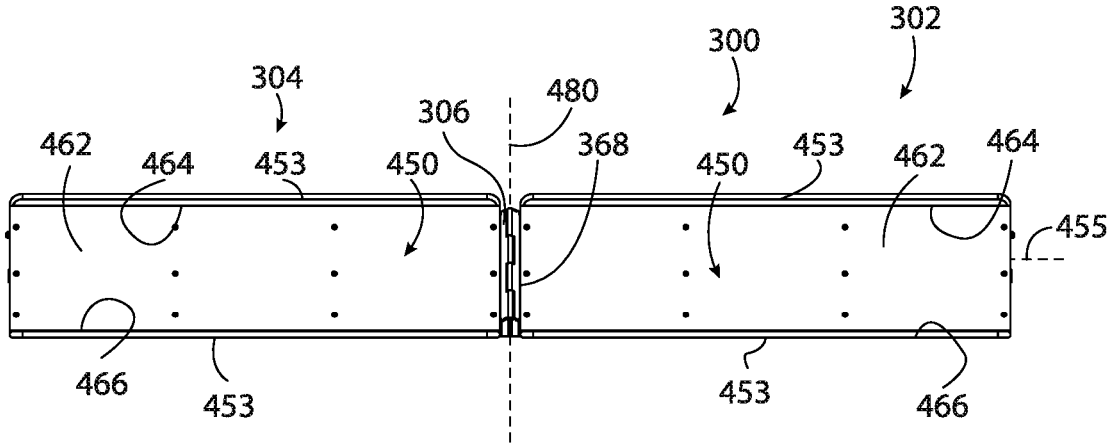

It is seen in FIGS. 21-21D that the first plow blade assembly 302 and the second plow blade assembly 304 extend along a single mutual longitudinal axis 455 in use, when connected to each other by the hinge brackets 306.

It is noted that the blade assemblies 302 and 304 are assembled as described and illustrated with reference to FIGS. 18A-18C. Typically, a bounding rod 453 is formed along at least a portion of the longitudinal extend of upper edge 464 of the blade 450 and a bounding rod 453 is formed along at least a portion of the longitudinal extend of lower edge 466 of the blade 450. The bounding rods 543 are preferably made of a resilient material and generally extend radially inwardly from the blade 450 and extend at an angle relative to the upper and lower edges of the blades 450. The lower bounding rod 453 is adapted for absorbing impact of obstacles on the surface and for effective plowing of the snow from the surface. The upper bounding rod 453 is adapted for effective concentration of the snow and direction thereof forwardly. It is noted that the lower bounding rod 453 preferably has a typically rounded tip. It is also noted that the bounding rods 453 are preferably replaceable.

It is noted that alternatively, the snowplow assembly 300 may not employ bounding rods 453, rather the blades 450 may be integrally formed having a greater curvature at the upper and lower edges thereof.

It is further seen in FIGS. 21A-21C that the supporting assembly 310 is fixedly coupled to the blade assemblies 302 and 304 in this open operative orientation. It is specifically seen that the first adjusting bracket 340 is fixedly attached to one of the support rods 454 of the first plow blade assembly 302 and the second adjusting bracket 350 is fixedly attached to one of the support rods 454 of the second plow blade assembly 304.

It is seen in this particular position shown in FIGS. 21A-21C that the securing pin 360 is inserted into opening 554 of the first adjusting bracket 340, thereby fixedly connecting the second arm 320 to the first adjusting bracket 340 and the rearward end of the second arm 320 is fixedly connected to the base portion 316.

It is also seen in this particular position shown in FIGS. 21A-21C that the securing pin 370 is inserted into opening 564 of the second adjusting bracket 350, thereby fixedly connecting the third arm 322 to the second adjusting bracket 350 and the rearward end of the third arm 322 is fixedly connected to the base portion 316.

Connecting bracket 330 is fixedly attached to the support rods 454 of the first plow blade assembly 302. The connecting bracket 330 is in turn selectably pivotably connected to the forward end of the first arm 318 by means of pin 332 inserted into a pivot axle 543, extending along axis 550. The first arm 318 is fixedly connected to the base portion 316 at the rearward end thereof.

It is noted that the first arm 318 preferably extends in parallel to hitch tube 400 and thus in parallel to the longitudinal axis 500.

It is a particular feature of an embodiment of the present invention that the angular positioning of the blade assemblies 302 and 304 relative to the hitch tube 400 is defined by the angular positioning between the first, second and third arms 318, 320 and 322, which is in turn defined by insertion of the securing pin 360 into a different opening out of openings 552, 554 and 556 of the first adjusting bracket 340 and by insertion of the securing pin 370 into a different opening out of openings 562, 564 and 566 of the second adjusting bracket 350. It is noted that the blade assemblies 302 and 304 are adapted for pivoting left or right due to the selectably pivoting connection of the first arm 318 and the connecting bracket 330, defined by the angular positioning of the second and third arms 320 and 322 relative to the plow blade assemblies 302 and 304.

It is a particular feature of an embodiment of the present invention that the connecting rod 380 is configured to selectably couple the first plow blade assembly 302 with the second plow blade assembly 304, thus fixating the first and second plow blade assemblies 302 and 304 relative to each other, and wherein the connecting rod 380 is configured to selectably release the second plow blade assembly 304 from the first plow blade assembly 302.

It is seen in FIGS. 21A-21C that the connecting rod 380 fixedly connects the first plow blade assembly 302 with the second blade assembly 304, such that the first plow blade assembly 302 and the second plow blade assembly 304 extend along a single mutual longitudinal axis 455.

Specifically, connecting rod 380 is releasably connected to the second plow blade assembly 304 by means of securing pin 381 inserted through holding plate 382 attached to the second plow blade assembly 304 and through opening 384 formed at one side of the connecting rod 380. The connecting rod 380 is further releasably connected to the first plow blade assembly 302 by means of a fastener inserted through holding plate 386 attached to the first plow blade assembly 302 and through opening 388 formed at another side of the connecting rod 380. The holding plate 386 is fixedly secured to the first plow blade assembly 302. The holding plate 382 is fixedly secured to the second plow blade assembly 304.

It is noted that any other method of connecting the connecting rod 380 with the first and second plow blade assemblies 302 and 304 is also within the scope of the present invention.

Figure 22:
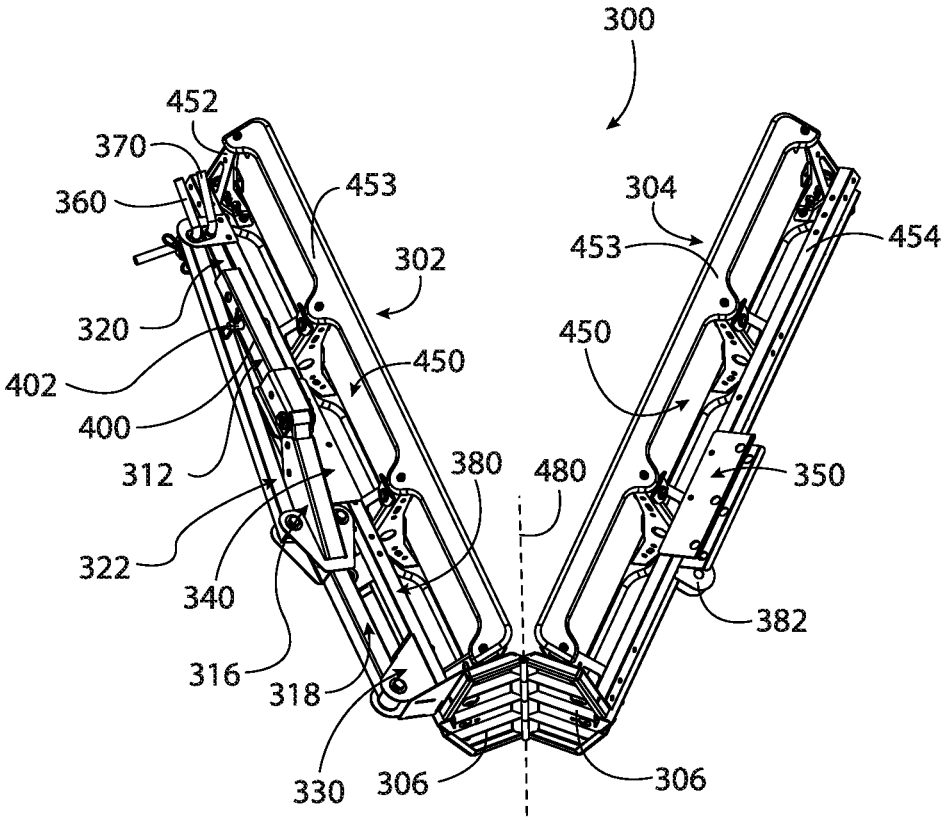
FIG. 22 is a simplified perspective view of the snowplow assembly of FIGS. 16-20, shown in a semi-folded operative orientation.
Figure 23A:
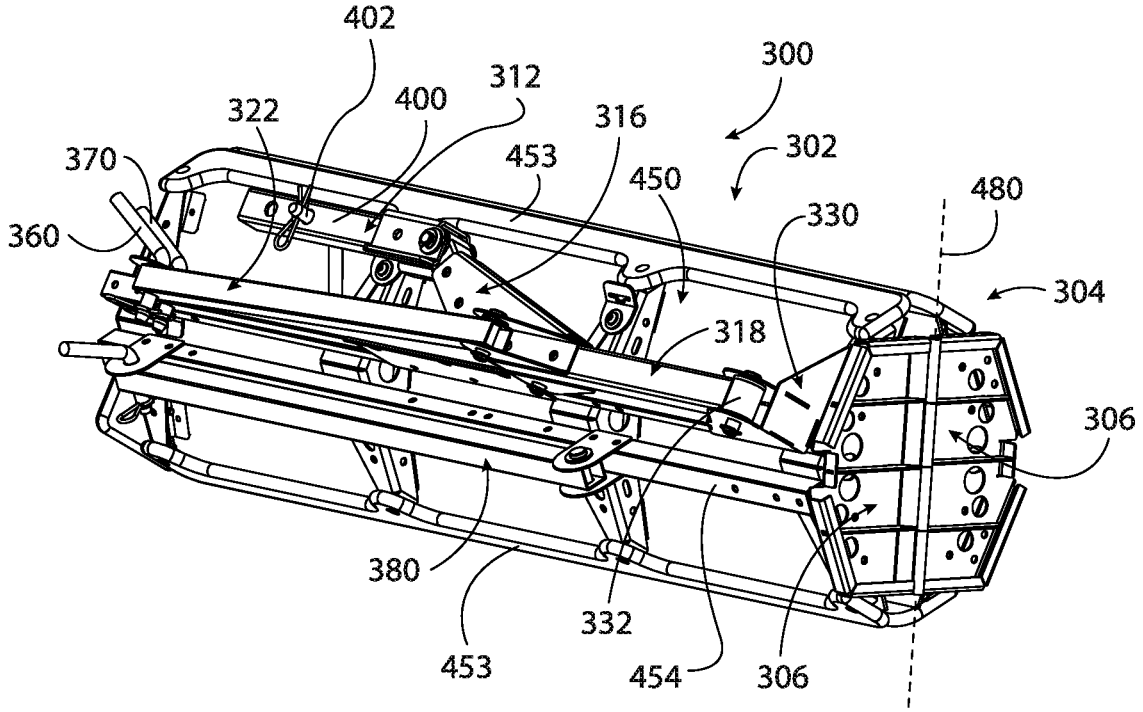
FIGS. 23A and 23B are two different simplified pictorial illustrations taken from different perspectives of the snowplow assembly of FIGS. 16-20, shown in a fully-folded operative orientation.
Figure 23B:
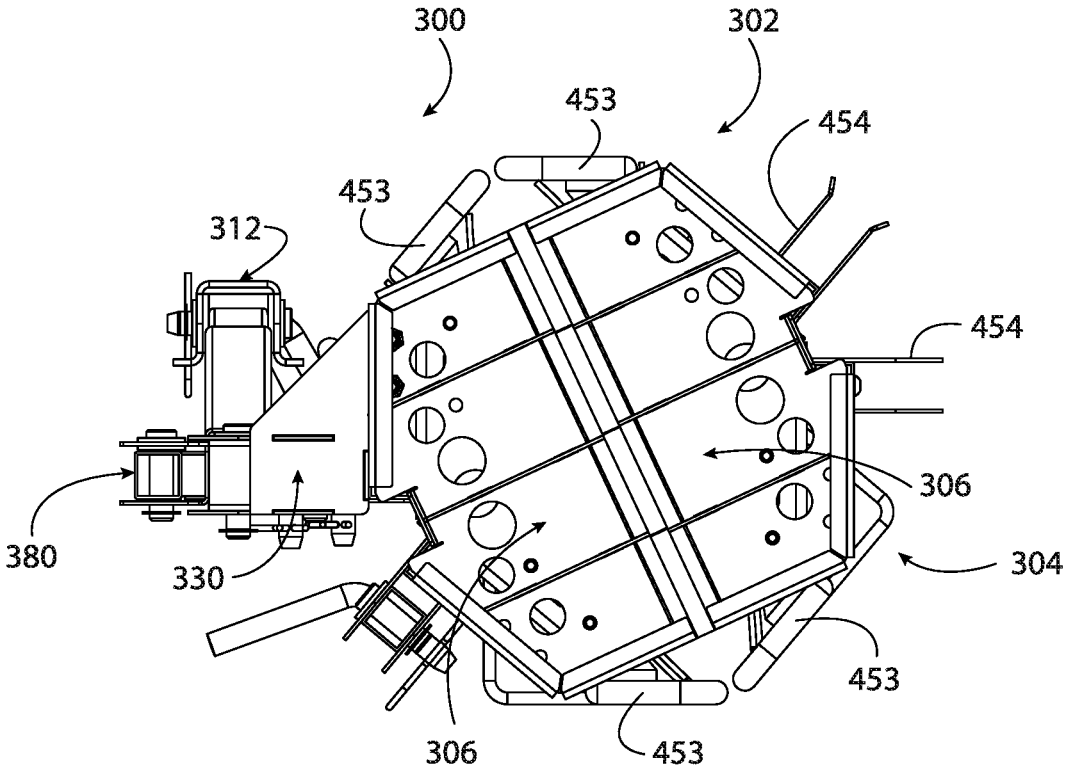

Reference is now made to FIG. 22, which is a simplified perspective view of the snowplow assembly 300 of FIGS. 16-20, shown in a semi-folded operative orientation and to FIGS. 23A and 23B, which are two different simplified pictorial illustrations taken from different perspectives of the snowplow assembly 300 of FIGS. 16-20, shown in a fully-folded operative orientation.

It is a particular feature of an embodiment of the present invention, as seen in FIGS. 22 and 23A & 23B, that the blade assemblies 302 and 304 are adapted to be folded in half toward each other about axis 180 provided between the two hinge brackets 306 upon release of the connecting rod 380 from the blade assembly 304.

FIG. 22 shows the snowplow assembly 300 is a semi-folded operative orientation. The securing pin 381 is removed from the holding plate 382 of the connecting rod 380, thus releasing the connecting rod 380 from the second plow blade assembly 304. Additionally, the securing pin 370 is removed from one of the openings 562, 564 or 566 of the second adjusting bracket 350 and thus allowing pivotable displacement between the two blade assemblies 302 and 304.

It is noted that once the connecting rod 380 is released, it can be secured to one of the holding plates that are secured to the first plow blade assembly 302 by insertion of a pin through the opening 384 formed in the connecting rod 380 and a corresponding opening formed in the holding plate.

It is further noted that once the third arm 322 is released by removing the securing pin 370, pivoting of the first arm 318 is permitted about axis 308, due the pivotable connection of the first arm 318 to the connecting bracket 330 by means of pin 332. The third arm 322 can be secured to one of the holding plates that are secured to the first plow blade assembly 302 by insertion of the securing pin 370 through the opening formed in the holding plate. The second arm 320 can also be released by removing the securing pin 360. Further pivoting of the first arm 318 is then permitted about axis 308, due the pivotable connection of the first arm 318 to the connecting bracket 330 by means of pin 332. The second arm 320 can be secured to one of the holding plates that are secured to the first plow blade assembly 302 by insertion of the securing pin 360 through the opening formed in the holding plate.

It is a particular feature of an embodiment of the present invention that the connecting rod 380, the first arm 318, the second arm 320 and the third arm 322 are releasably locked to the first plow blade assembly 302 in this fully folded operative orientation.

It is particularly seen in FIGS. 23A and 23B that the two blade assemblies 302 and 304 are fully folded over each other, such that the forwardly facing surfaces 362 of the respective blade assemblies 302 and 304 are facing each other and the two hinge brackets 306 are preferably coplanar in this fully-folded operative orientation.

It is noted that a latch (not shown) may be provided for latching the two blade assemblies 302 and 304 together in this fully-folded operative orientation to provide for easy storage of the snowplow assembly 300 when not in use.

Figure 24:
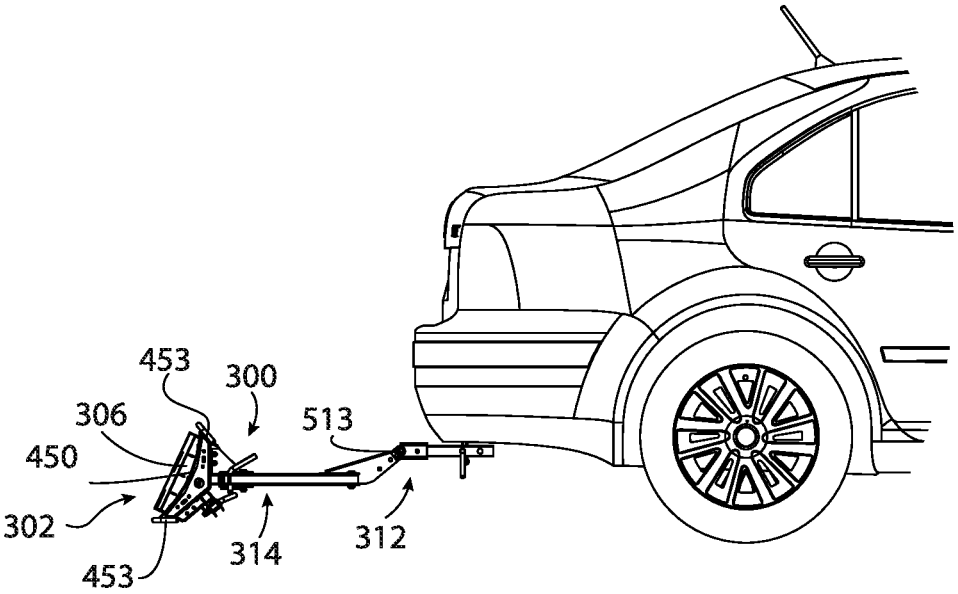
FIG. 24 is a simplified side plan view illustration of the snowplow assembly of FIG. 16-20 mounted onto a vehicle and shown in a lowered operative orientation.

Reference is now made to FIG. 24, which is a simplified side plan view illustration of the snowplow assembly 300 of FIG. 16-20 mounted onto a vehicle and shown in a lowered operative orientation.

It is seen in FIG. 24 that while in use, the snowplow assembly 300 is positioned in a lowered operative orientation, touching the surface of the ground to facilitate snow removal therefrom. The supporting arm assembly 314 is pivotable relative to the hitch connector 312 about axis 508 due to gravity. In this lowered operative orientation, the supporting arm assembly 314 is pivotably displaced downwardly relative to the hitch tube 400 of the hitch connector 312 about axis 508 up to engagement of the lower bounding rod 453 with the ground. In this operative orientation, the snowplow assembly 300 is configured for plowing snow from the ground.

In accordance with another embodiment of the present invention, the supporting arm assembly 314 is held in the lowered position relative to the hitch connector 312 by means of a biasing force pushing the supporting arm assembly 314 downwardly, such as for example a torsion spring mounted onto pivoting axle 513.

It is appreciated that any other suitable biasing mechanism ensuring lowering of the supporting arm assembly 314 to the ground is conceived to be part of the present invention.

Figure 25:
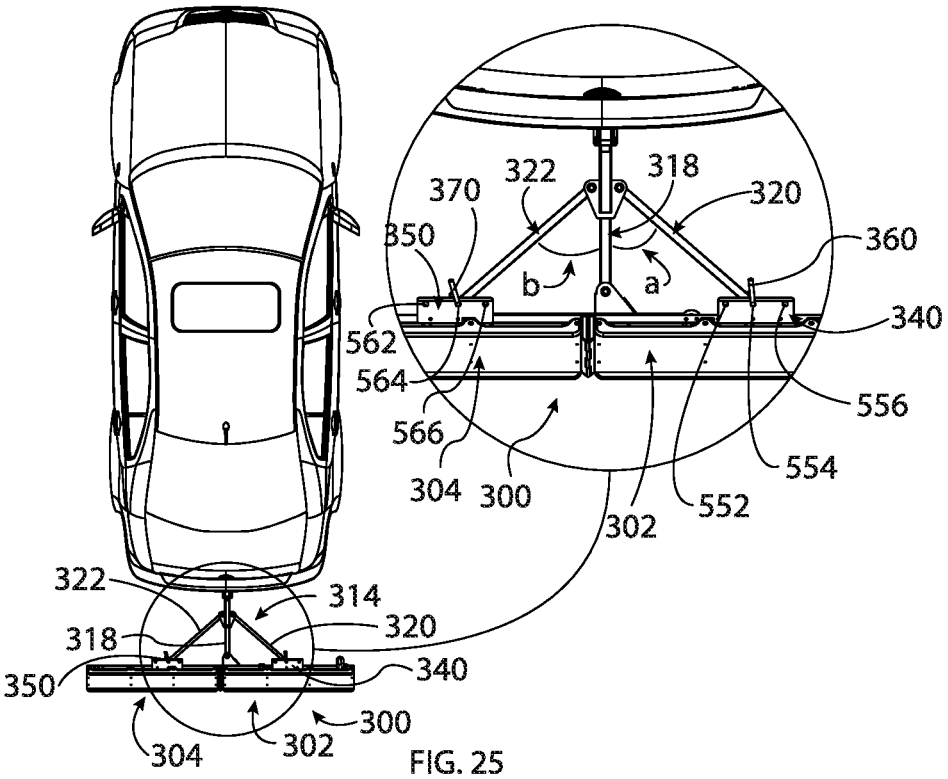
FIG. 25 is a simplified top plan view illustration of the snowplow assembly of FIGS. 16-20 mounted onto a vehicle and shown in a straight orientation.

Reference is now made to FIG. 25, which is a simplified top plan view illustration of the snowplow assembly 300 of FIGS. 16-20 mounted onto a vehicle and shown in a straight orientation.

It is a particular feature of an embodiment of the present invention that the snowplow assembly 300 is positioned in a straight orientation relative to the vehicle, such that the first arm 318 is positioned generally transversely relative to the first and to the second plow blade assemblies 302 and 304, whereas the first plow blade assembly 302 and the second plow blade assembly 304 extend along a single mutual longitudinal axis 455 when connected to each other by the hinge brackets 306.

It is particularly seen in the enlargement of FIG. 25 that in this straight orientation of the snowplow assembly 300, the second arm 320 is secured to the first plow blade assembly 302 via the first adjusting bracket 340, such that the securing pin 360 is inserted through opening 554 of the first adjusting bracket 340. It is additionally particularly seen in the enlargement of FIG. 25 that in this straight orientation of the snowplow assembly 300, the third arm 322 is secured to the second plow blade assembly 304 via the second adjusting bracket 350, such that the securing pin 370 is inserted through opening 564 of the second adjusting bracket 350.

It is seen in the enlargement of FIG. 25 that the second arm 320 is disposed at an angle "a" relative to the first arm 318 and the third arm 322 is disposed at an angle "b" relative to the first arm 318 in this straight orientation of the snow plow assembly 300. It is seen that the second arm 320 and the third arm 322 extend in mutually opposite radial directions from the first arm 318. The second arm 320 is adapted for connecting the first arm 318 to the first plow blade assembly 302 and the third arm 322 is adapted for connecting the first arm 318 to the second plow blade assembly 304.

It is a particular feature of an embodiment of the present invention that the angles "a" and "b" at which the second and third arms 320 and 322 are positioned with respect to the first arm 318 define the angular orientation of both the first and the second plow blade assemblies 302 and 304 relative to the hitch connector 312, and thus relative to the vehicle.

Figure 26:
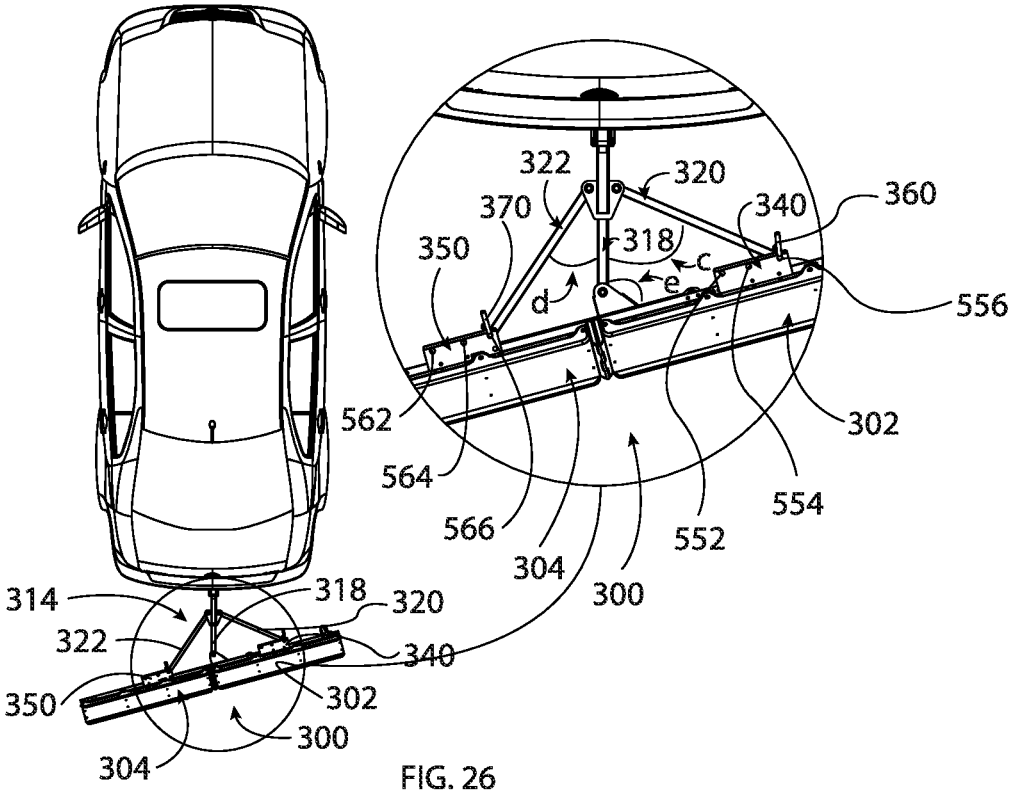
FIG. 26 is a simplified top plan view illustration of the snowplow assembly of FIGS. 16-20 mounted onto a vehicle and shown in a first tilted orientation.

Reference is now made to FIG. 26, which is a simplified top plan view illustration of the snowplow assembly 300 of FIGS. 16-20 mounted onto a vehicle and shown in a first tilted orientation.

It is seen that in this tilted to the right operative orientation the blade assemblies 302 and 304 are both disposed generally at an angle "e" relative to the straight orientation. In this position, the blade assemblies 302 and 304 are disposed at an angle with respect to the first arm 318, whereas the first plow blade assembly 302 and the second plow blade assembly 304 extend along the single mutual longitudinal axis 455 when connected to each other by the hinge brackets 306.

It is noted that the angular adjustment of both the first and the second blade assemblies 302 and 304 relative to the first arm 318 is provided by coupling the second arm 320 to the first adjusting bracket 340 at a certain angular orientation, while securing it by insertion of the securing pin 360 through opening 556 of the first adjusting bracket 340. Additionally, the third arm 322 is coupled to the second adjusting bracket 350 at a certain angular orientation, while securing it by insertion of the securing pin 370 through opening 566 of the second adjusting bracket 350.

It is particularly seen in the enlargement of FIG. 26 that in this tilted to the right orientation of the snowplow assembly 300, the second arm 320 is secured to the first plow blade assembly 302 via the first adjusting bracket 340, such that the securing pin 360 is inserted through opening 556 of the first adjusting bracket 340. It is additionally particularly seen in the enlargement of FIG. 26 that in this tilted to the right orientation of the snowplow assembly 300, the third arm 322 is secured to the second plow blade assembly 304 via the second adjusting bracket 350, such that the securing pin 370 is inserted through opening 566 of the second adjusting bracket 350.

It is seen in the enlargement of FIG. 26 that the second arm 320 is disposed at an angle "c" relative to the first arm 318, which is generally greater than angle "a", and the third arm 322 is disposed at an angle "b" relative to the first arm 318, which is generally smaller than angle "b" in this tilted to the right orientation of the snow plow assembly 300. It is seen that the second arm 320 and the third arm 322 extend in mutually opposite radial directions from the first arm 318. The second arm 320 is adapted for connecting the first arm 318 to the first plow blade assembly 302 and the third arm 322 is adapted for connecting the first arm 318 to the second plow blade assembly 304.

It is noted that the angle "e" can be within any range of angles, depending on the location of the plurality of openings formed on the first and second adjusting brackets 340 and 350.

Figure 27:
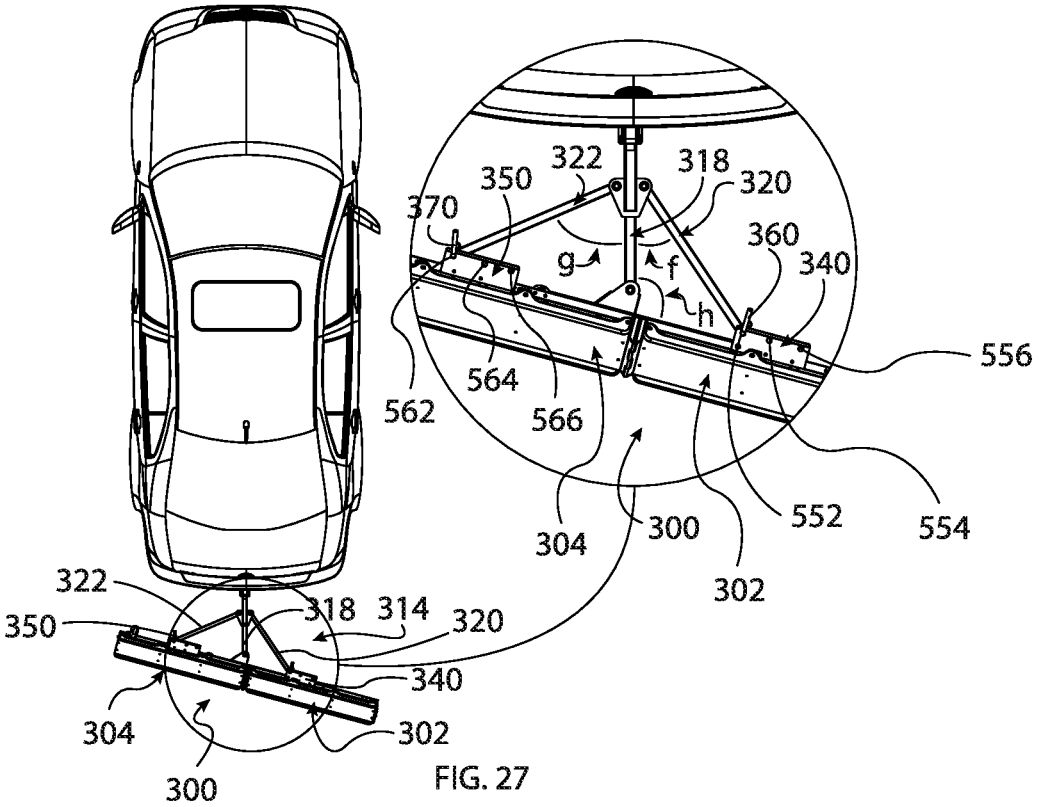
FIG. 27 is a simplified top plan view illustration of the snowplow assembly of FIGS. 16-20 mounted onto a vehicle and shown in a second tilted orientation.

Reference is now made to FIG. 27, which is a simplified top plan view illustration of the snowplow assembly 300 of FIGS. 16-20 mounted onto a vehicle and shown in a second tilted orientation.

It is seen that in this tilted to the left operative orientation the blade assemblies 302 and 304 are both disposed generally at an angle "h" relative to the straight orientation. In this position, the blade assemblies 302 and 304 are disposed at an angle with respect to the first arm 318, whereas the first plow blade assembly 302 and the second plow blade assembly 304 extend along the single mutual longitudinal axis 455 when connected to each other by the hinge brackets 306.

It is noted that the angular adjustment of both the first and the second blade assemblies 302 and 304 relative to the first arm 318 is provided by coupling the second arm 320 to the first adjusting bracket 340 at a certain angular orientation, while securing it by insertion of the securing pin 360 through opening 552 of the first adjusting bracket 340. Additionally, the third arm 322 is coupled to the second adjusting bracket 350 at a certain angular orientation, while securing it by insertion of the securing pin 370 through opening 562 of the second adjusting bracket 350.

It is particularly seen in the enlargement of FIG. 27 that in this tilted to the left orientation of the snowplow assembly 300, the second arm 320 is secured to the first plow blade assembly 302 via the first adjusting bracket 340, such that the securing pin 360 is inserted through opening 552 of the first adjusting bracket 340. It is additionally particularly seen in the enlargement of FIG. 27 that in this tilted to the left orientation of the snowplow assembly 300, the third arm 322 is secured to the second plow blade assembly 304 via the second adjusting bracket 350, such that the securing pin 370 is inserted through opening 562 of the second adjusting bracket 350.

It is seen in the enlargement of FIG. 27 that the second arm 320 is disposed at an angle "f" relative to the first arm 318, which is generally smaller than angle "a", and the third arm 322 is disposed at an angle "g" relative to the first arm 318, which is generally greater than angle "b" in this tilted to the left orientation of the snow plow assembly 300. It is seen that the second arm 320 and the third arm 322 extend in mutually opposite radial directions from the first arm 318. The second arm 320 is adapted for connecting the first arm 318 to the first plow blade assembly 302 and the third arm 322 is adapted for connecting the first arm 318 to the second plow blade assembly 304.

It is noted that the angle "h" can be within any range of angles, depending on the location of the plurality of openings formed on the first and second adjusting brackets 340 and 350.

Figure 28:
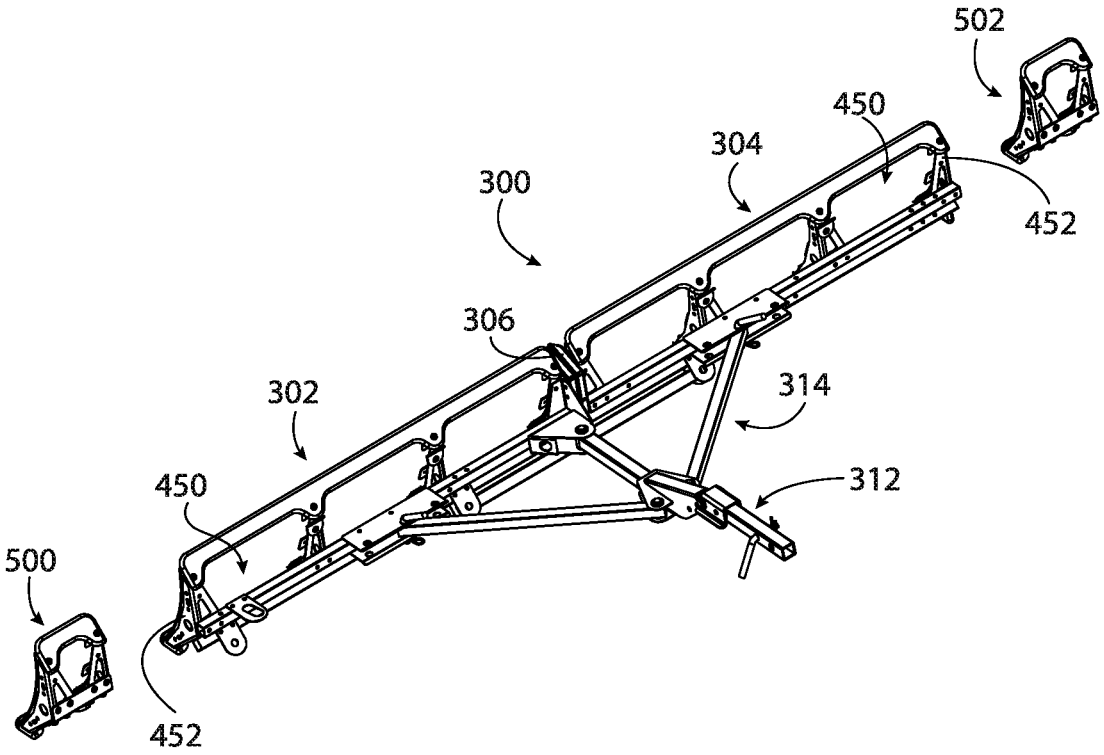
FIG. 28 is a simplified exploded view illustration of a snowplow assembly constructed and operative in accordance with still another embodiment of the present invention.
Figure 29:
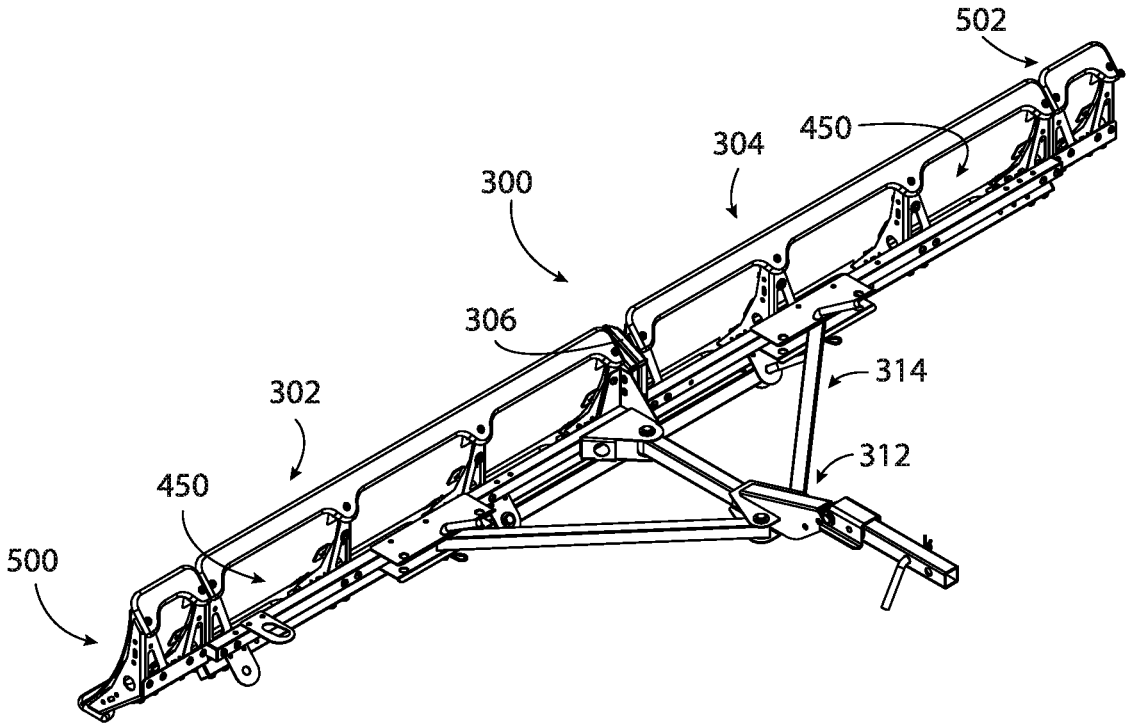
FIG. 29 is a simplified assembled illustration of the snowplow assembly of FIG. 28.

Reference is now made to FIG. 28, which is a simplified exploded view illustration of the snowplow assembly 300 constructed and operative in accordance with still another embodiment of the present invention and to FIG. 29, which is a simplified assembled illustration of the snowplow assembly 300 of FIG. 28.

It is a particular feature of another embodiment of the present invention that extension portions 500 and 502 may be provided and configured to be releasably connected to each one of the first and the second plow blade assemblies 302 and 304, thereby increasing the effective length of the plow blade assemblies 302 and 304. It is noted that the first plow blade assembly 302, the second plow blade assembly 304 and the extension portions 500 and 502 extend along the single mutual longitudinal axis 455 when connected to each other by the hinge brackets 306.

It is noted that the extension portions 500 and 502 are configured to be removably connected to the plow blade assemblies 302 and 304 by means of fasteners, coupling the side walls of the extension portions 500 and 502 with the holding brackets 452 of the first and second plow blade assemblies 302 and 304.

It will be appreciated by persons skilled in the art that the present invention is not limited by what has been particularly shown and described hereinabove. Rather the scope of the present invention includes both combinations and subcombinations of various features described hereinabove as well as variations and modifications thereof which are not in the prior art.

The invention claimed is:

1. A snowplow assembly configured for attachment to a vehicle comprising:

a first plow blade assembly having a forwardly facing surface configured to face away from the vehicle and a rearwardly facing surface configured to face toward the vehicle and a second plow blade assembly having a forwardly facing surface configured to face away from the vehicle and a rearwardly facing surface configured to face toward the vehicle, connectable to each other by a hinge;

a support assembly having a base arm extending along a longitudinal axis and having at least two arms extending in different angular directions with respect to said base arm, a first one of said at least two arms is selectably fixedly attached to said rearwardly facing surface of said first plow blade assembly and a second one of said at least two arms is selectably fixedly attached to said rearwardly facing surface of said second plow blade assembly, thus selectably fixating the first and second plow blades respective rearwardly facing surfaces to said support assembly; and a connecting rod, configured to connect said first plow blade assembly to said second plow blade assembly in a first operative orientation and configured to selectably release said second plow blade assembly from said first plow blade assembly in a second operative orientation, thereby allowing pivotable folding of said first and second plow blade assemblies about said hinge, so as said forwardly facing surfaces of said first plow blade assembly and said second plow blade assembly face each other upon selectably detaching said second one of said at least two arms from said second plow blade assembly, and wherein said first and second plow blade assemblies extend along a mutual longitudinal axis when connected to each other by said hinge and fixated by said connecting rod.

2. The snowplow assembly according to claim 1 and wherein adjustment of angular orientation of said first one of said at least two arms relative to said first plow blade assembly and adjustment of said second one of said at least two arms relative to said second plow blade assembly provides for adjustment of angular orientation of both said first and second plow blade assemblies relative to said base arm.

3. The snowplow assembly according to claim 1 and wherein at least one of said at least two arms is configured to be attached to either said first plow blade assembly or said second plow blade assembly by a bracket having an array of spaced apart openings formed therein and a fastener that is selectably insertable into one of said openings.

4. The snowplow assembly according to claim 3 and wherein relative angular orientation between both said first and second plow blade assemblies and said base arm is configured to be adjusted by changing the position of said fastener to be inserted into a different one of said openings.

5. The snowplow assembly according to claim 1, further comprising at least one extension configured to be releasably connected to at least one of said first and second plow blade assemblies, thereby increasing the effective length thereof.

6. The snowplow assembly according to claim 1 and wherein said support assembly further comprises a base portion that is pivotably connected to a hitch connector.

7. The snowplow assembly according to claim 1 and wherein said base arm is pivotably connected to said first plow blade assembly or to said second plow blade assembly.

8. A snowplow assembly configured for attachment to a vehicle comprising:

a first plow blade assembly having a forwardly facing surface configured to face away from the vehicle and a rearwardly facing surface configured to face toward the vehicle and a second plow blade assembly having a forwardly facing surface configured to face away from the vehicle and a rearwardly facing surface configured to face toward the vehicle, connectable to each other by a hinge;

a support assembly fixedly couplable to said rearwardly facing surface of said first plow blade assembly and comprising at least one connecting rod;

said at least one connecting rod is configured to selectably couple said support assembly with said rearwardly facing surface of said second plow blade assembly, thus fixating the first and second plow blade assemblies relative to each other, and wherein said at least one connecting rod is configured to selectably release said second plow blade assembly from said support assembly to allow pivotable folding of said first and second plow blade assemblies about said hinge, so as said forwardly facing surfaces of said first plow blade assembly and said second plow blade assembly face each other, and wherein said first and second plow blade assemblies extend along a mutual longitudinal axis when connected to each other by said hinge and fixated by said connecting rod.

9. A snowplow assembly for attachment to a vehicle, comprising:

a first plow blade assembly having a forwardly facing surface configured to face away from the vehicle and a rearwardly facing surface configured to face toward the vehicle and a second plow blade assembly having a forwardly facing surface configured to face away from the vehicle and a rearwardly facing surface configured to face toward the vehicle, connectable to each other by a hinge;

a support assembly fixedly couplable to said rearwardly facing surface of said first plow blade assembly and comprising a connecting rod;

wherein said first and second plow blade assemblies are pivotably folded so as said forwardly facing surfaces of said first plow blade assembly and said second plow blade assembly face each other upon releasing said connecting rod from said second plow blade assembly, and wherein said first and second plow blade assemblies extend along a mutual longitudinal axis when connected to each other by said hinge and fixated by said connecting rod.

10. The snowplow assembly according to claim 9 and wherein said support assembly further comprising a supporting arm that is pivotably connected to a hitch connector and an adjusting bracket that is pivotably connected to the supporting arm and wherein said adjusting bracket is selectably pivotably connected to said connecting rod.

11. The snowplow assembly according to claim 10 and wherein said supporting arm is biased downwardly to the ground when not being secured in a raised operative orientation.

12. The snowplow assembly according to claim 10 and wherein said adjusting bracket is configured to be moveably coupled to said supporting arm, thereby providing automatic angular adjustment of said first and second plow blade assemblies relative to said supporting arm upon application of different load along a longitudinal extent of at least one of the plow blade assemblies.

13. The snowplow assembly according to claim 10 and wherein said adjusting bracket is configured to be fixed relative to said supporting arm when said connecting rod is coupled with said second plow blade assembly.

14. The snowplow assembly according to claim 10 and wherein said connecting rod is securable to said supporting arm in a folded operative orientation of said snowplow assembly.

15. The snowplow assembly according to claim 9 and wherein at least one replaceable lip is attached along at least a portion of an edge of a blade, forming part of said first and second plow blade assembly.

16. The snowplow assembly according to claim 8 and wherein said support assembly further comprising a supporting arm that is pivotably connected to a hitch connector and an adjusting bracket that is pivotably connected to the supporting arm and wherein said adjusting bracket is selectably pivotably connected to said connecting rod.

17. The snowplow assembly according to claim 16 and wherein said supporting arm is biased downwardly to the ground when not being secured in a raised operative orientation.

18. The snowplow assembly according to claim 16 and wherein said adjusting bracket is configured to be moveably coupled to said supporting arm, thereby providing automatic angular adjustment of said first and second plow blade assemblies relative to said supporting arm upon application of different load along a longitudinal extent of at least one of the plow blade assemblies.

19. The snowplow assembly according to claim 16 and wherein said adjusting bracket is configured to be fixed relative to said supporting arm when said connecting rod is coupled with said second plow blade assembly.

20. The snowplow assembly according to claim 16 and wherein said connecting rod is securable to said supporting arm in a folded operative orientation of said snowplow assembly.

* * * * *